US009624618B2

(12) United States Patent
Del Pos et al.

(10) Patent No.: US 9,624,618 B2
(45) Date of Patent: Apr. 18, 2017

(54) LAUNDRY WASHING MACHINE

(71) Applicant: Electrolux Appliances Aktiebolag, Stockholm (SE)

(72) Inventors: Maurizio Del Pos, Pordenone (IT); Daniele Favaro, Venice (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 0 days.

(21) Appl. No.: 14/765,997

(22) PCT Filed: Feb. 6, 2013

(86) PCT No.: PCT/EP2013/052272
§ 371 (c)(1),
(2) Date: Aug. 5, 2015

(87) PCT Pub. No.: WO2014/121820
PCT Pub. Date: Aug. 14, 2014

(65) Prior Publication Data

US 2016/0010266 A1 Jan. 14, 2016

(51) Int. Cl.
*D06F 39/02* (2006.01)
*D06F 39/00* (2006.01)
(Continued)

(52) U.S. Cl.
CPC ..... *D06F 39/007* (2013.01); *D06F 33/00* (2013.01); *D06F 39/005* (2013.01); *D06F 39/02* (2013.01); *D06F 39/085* (2013.01)

(58) Field of Classification Search
CPC ..... D06F 39/007; D06F 39/02; D06F 39/022; D06F 39/028; A47L 15/4229
(Continued)

(56) References Cited

U.S. PATENT DOCUMENTS 3,148,687 A 9/1964 Dosch
3,386,582 A * 6/1968 Brezosky ..... A47L 15/4229 210/136
6,557,382 B1 * 5/2003 Koike ..... D06F 39/007 68/13 A

FOREIGN PATENT DOCUMENTS

DE 3520202 A1 12/1986
DE 3521598 A1 12/1986
(Continued)

OTHER PUBLICATIONS

International Search Report mailed May 29, 2013 in related International Application No. PCT/EP2013/052272.
(Continued)

*Primary Examiner* — David Cormier
*Assistant Examiner* — Thomas Bucci
(74) *Attorney, Agent, or Firm* — Banner & Witcoff, Ltd.

(57) ABSTRACT

A laundry washing machine (1) having an outer casing (2) and, inside the outer casing (2), a washing tub (3), a detergent dispensing assembly (9) structured for supplying detergent into the washing tub (3), and a fresh-water supply circuit (10) structured for selectively channeling a flow of fresh water from the water mains towards the detergent dispensing assembly (9) and/or the washing tub (3). A water softening device (12) is arranged/located along the fresh-water supply circuit (10) and is structured for reducing the hardness degree of the fresh water channeled to the detergent dispensing assembly (9) and/or the washing tub (3). The water softening device (12) being internally provided with a given amount of water softening agent to reduce the hardens degree of the fresh water flowing through the same water softening device (12), and with a given amount of consumable regeneration agent regenerate the water softening function of the water softening agent. The laundry washing machine (1) further having an appliance control panel (11)
(Continued)

structured for allowing the user to manually select the desired washing-cycle and located/arranged on front of a drawer-like supporting structure (13) fitted/inserted in extractable manner into the front wall (2*a*) of the casing (2), so as to be movable between a retracted position in which the drawer-like supporting structure (13) is recessed into the front wall (2*a*) of the casing (2) and the appliance control panel (11) is arranged substantially coplanar to the front wall (2*a*) of the casing (2), and a extracted position in which the drawer-like supporting structure (13) partly juts out from front wall (2*a*) of the casing (2) and the appliance control panel (11) is forward spaced apart from front wall (2*a*) of the casing (2). The water softening device (12) being provided with an exposable loading inlet or mouth (33*a,* 52) structured for allowing the user to load the regeneration agent inside the regeneration-agent reservoir (29), and being at least partly arranged/located on the drawer-like supporting structure (13) so that said loading inlet or mouth (33*a,* 52) is freely accessible by the user when the drawer-like supporting structure (13) is arranged in the extracted position.

16 Claims, 8 Drawing Sheets

(51) Int. Cl.
*D06F 33/00* (2006.01)
*D06F 39/08* (2006.01)

(58) Field of Classification Search
USPC ..... 68/13 A, 17 R, 12.18, 207, 13 R, 200, 68/23.5; 134/57 D, 58 D, 115 R, 93, 109, 134/56 D, 18, 26, 29, 36, 7; 210/190, 210/191, 136, 140, 141, 687, 167.01; 222/651, 129, 325, 1, 132, 145.5, 189.11, 222/318
See application file for complete search history.

(56) References Cited

FOREIGN PATENT DOCUMENTS

| | | | | |
|---|---|---|---|---|
| DE | 3527047 | A1 | 2/1987 | |
| DE | 10245281 | A1 | 4/2004 | |
| DE | 102008027726 | B3 | 10/2009 | |
| EP | 0496957 | A1 | 8/1992 | |
| EP | 1085118 | A2 | 3/2001 | |
| EP | 2113602 | A1 | 11/2009 | |
| IT | WO 2011128745 | A2 * | 10/2011 | ..... A61K 8/19 |
| WO | 2011128745 | A2 | 10/2011 | |
| WO | 2011154426 | A1 | 12/2011 | |

OTHER PUBLICATIONS

International Search Report mailed Jun. 4, 2013 in related International Application No. PCT/EP2013/052303.
International Search Report mailed May 29, 2013 in related International Application No. PCT/EP2013/052275.
International Search Report mailed Jun. 4, 2013 in related International Application No. PCT/EP2013/052299.

* cited by examiner

LAUNDRY WASHING MACHINE

BACKGROUND

The present invention relates to a laundry washing machine.

In particular, the present invention relates to a front-loading home laundry washing machine provided with an internal water softening device, to which the following description refers purely by way of example without this implying any loss of generality.

As is known, currently marketed front-loading home laundry washing machines generally comprise: a substantially parallelepiped-shaped outer boxlike casing structured for resting on the floor; a substantially bell-shaped washing tub which is suspended in floating manner inside the casing, directly facing a laundry loading/unloading through opening realized in the front wall of the casing; a substantially cylindrical elastically-deformable bellows, which connects the front opening of the washing tub to the laundry loading/unloading opening formed in the front wall of the casing; a porthole door which is hinged to the front wall of the casing to rotate to and from a closing position in which the door closes the laundry loading/unloading opening in the front wall of the casing for watertight sealing the washing tub; a substantially cylindrical, bell-shaped rotatable drum structured for housing the laundry to be washed, and which is arranged inside the washing tub with its concavity facing the laundry loading/unloading opening and is supported in axially rotating manner so as to be able to freely rotate about its substantially horizontally-oriented longitudinal axis; and finally an electrically-powered motor assembly which is structured for driving into rotation the rotatable drum about its longitudinal axis inside the washing tub.

Alike any other home laundry washing machine, this type of laundry washing machine is furthermore provided with a detergent dispensing assembly which is generally located inside the boxlike casing, immediately above the washing tub, and is structured for selectively feeding into the washing tub, according to the washing cycle manually-selected by the user via a control panel generally located on the front wall of the boxlike casing, a given amount of detergent, softener and/or other washing agent suitably mixed with fresh water arriving from the water mains; and with a fresh-water supply circuit structured for selectively drawing fresh water from the water mains according to the washing cycle manually-selected by the user, and channelling said water into the detergent dispensing assembly or directly into the washing tub.

The detergent dispensing assembly, in turn, generally comprises a detergent drawer which is usually divided into a number of detergent compartments each structured for being manually fillable with a corresponding detergent product, and which is fitted/inserted in manually extractable manner into a completely recessed drawer housing whose entrance is located on front wall of the boxlike casing, above the porthole door, and whose bottom directly communicates with the inside of the washing tub via a connecting duct.

The fresh-water supply circuit is structured for drawing fresh water from the water mains and selectively channelling said fresh water to the detergent dispensing assembly which, in turn, is structured to selectively and alternatively channelling the fresh water into any one of the detergent compartments of the detergent drawer, so as to selectively flush the detergent, softener or other washing agent out of the corresponding compartment and down on the bottom of the drawer housing, and afterwards sweep the detergent, softener or other washing agent away from the bottom of the drawer housing directly into the washing tub.

As is known the hardness of the fresh water drawn from the water mains deeply negatively influences the cleaning efficiency of the detergents and softeners used in the washing cycle, thus the user is usually requested to considerably increase, when the hardness degree of the fresh water is too high, the amount of detergent and softener used in the washing cycle and/or to mix the detergent with a given amount of very expensive, generally polycarboxylates-based, water-softening chemical product.

The European patent application No. 1085118 discloses a front-loading home laundry washing machine provided with an internal water softening device capable of reducing, during each washing cycle, the hardness degree of the fresh water used in the pre-washing and washing phases of the washing cycle. This water softening device uses ion-exchange resins to restrain calcium and magnesium ions ($Ca^{++}$ an $Mg^{++}$) dissolved in the fresh water channeled to the washing tub, and uses brine (i.e. salt water) to periodically regenerate these ion-exchange resins. Salt water, in fact, is able to remove from the ion-exchange resins the calcium and magnesium ions previously combined/fixed to said resins.

Unluckily integration of the salt reservoir on the back of the detergent drawer has brought to a very complicated detergent drawer structure with a consequent significant increase in the detergent dispensing assembly overall production costs.

Moreover the brine accidentally coming out of the salt reservoir during drawer movement accumulates on the bottom of the drawer housing which is in direct communication with the upper portion of the washing tub, thus the brine can reach quite easily the outer surface of the rotatable drum with all problems concerned. The rotatable drum, in fact, is generally made of metal material and gets rusty very quickly in presence of brine.

Last but not less important, the capacity of the salt reservoir on the back of the detergent drawer is too limited for the everyday-use typical of a traditional home laundry washing machine. It is unacceptable for a normal user to refill the salt reservoir every 3-4 washing cycles.

SUMMARY OF SELECTED INVENTIVE ASPECTS

An aim of the present invention is therefore to realize an internal water softening device designed to eliminate the drawbacks referred above.

In compliance with the above aims, according to an aspect of the present invention there is provided a laundry washing machine comprising an outer casing and, inside said outer casing, a washing tub, a rotatable drum housed in axially rotatable manner inside the washing tub and structured for housing the laundry to be washed, a detergent dispensing assembly which is structured for supplying detergent into the washing tub, a fresh-water supply circuit which is structured for selectively channeling a flow of fresh water from the water mains towards the detergent dispensing assembly and/or the washing tub, and a water softening device which is arranged/located along the fresh-water supply circuit and is structured for reducing the hardness degree of the fresh water channeled to the detergent dispensing assembly and/or the washing tub; the water softening device in turn comprising a water-softening agent container which is arranged/located along the fresh-water supply circuit and is filled with a water softening agent able to reduce the hardness degree of the fresh water flowing through the same water-softening agent container, and a regeneration-agent reservoir which is fluidically connected to the water-softening agent container and is structured to receive a consumable regeneration agent for performing a regeneration of the water softening function of the water softening agent stored into the water-softening agent container; the laundry washing machine furthermore comprising an appliance control panel which is structured for allowing the user to manually select the desired washing-cycle and is located on a front wall of the casing, and being characterized in that said appliance control panel is located/arranged at a front side of a drawer-like supporting structure which is fitted/inserted in extractable manner into the front wall of the casing, so as to be movable between a retracted position in which the drawer-like supporting structure is recessed into the front wall of the casing, and a extracted position in which the drawer-like supporting structure partly juts out from front wall of the casing and the appliance control panel is forward spaced apart from front wall of the casing; and in that the water softening device is provided with an exposable loading inlet or mouth structured for allowing the user to load the regeneration agent inside the regeneration-agent reservoir, and is moreover at least partly arranged/located on the drawer-like supporting structure so that said loading inlet or mouth is freely accessible by the user when the drawer-like supporting structure is arranged in the extracted position.

Preferably, though not necessarily, the laundry washing machine is furthermore characterized in that the washing tub comprises an opening or mouth directly facing a laundry loading/unloading opening realized in the front wall of the casing, and in that the drawer-like supporting structure is fitted/inserted in extractable manner into the front wall of the casing above said laundry loading/unloading opening.

Preferably, though not necessarily, the laundry washing machine is furthermore characterized in that the detergent dispensing assembly is provided with a corresponding exposable loading inlet or mouth which is structured for allowing the user to load the detergent or other washing agent inside the detergent dispensing assembly.

Preferably, though not necessarily, the laundry washing machine is furthermore characterized in that the detergent dispensing assembly is arranged inside the casing so that its loading inlet or mouth is located on front wall of the casing, beside the drawer-like supporting structure carrying the appliance control panel.

Preferably, though not necessarily, the laundry washing machine is furthermore characterized in that the detergent dispensing assembly comprises a detergent container which is fillable with a given quantity of detergent, softener and/or other washing agent, and which is housed inside the casing into a corresponding container housing; the front wall of the casing being provided with a corresponding pass-through opening through which the detergent container is accessible by the user.

Preferably, though not necessarily, the laundry washing machine is furthermore characterized in that the detergent dispensing assembly comprises a detergent drawer which is manually fillable with a given quantity of detergent, softener and/or other washing agent, and is fitted/inserted in manually extractable manner into a recessed drawer housing which extends inside the casing while remaining above the washing tub, and communicates with the outside of the casing via a front entrance or opening provided at the front wall of the casing above the laundry loading/unloading opening and beside the drawer-like supporting structure.

Preferably, though not necessarily, the laundry washing machine is furthermore characterized in that the water softening device furthermore comprises a water supply circuit which is structured for channelling a given amount of fresh water into the regeneration-agent reservoir so to at least partly dissolve the regeneration agents stored therein to form some brine.

Preferably, though not necessarily, the laundry washing machine is furthermore characterized in that the water softening device furthermore comprises a pump assembly or valve assembly which is interposed between the water-softening agent container and the regeneration-agent reservoir, and is structured for regulating/controlling the outflow of the brine from the regeneration-agent reservoir to the water-softening agent container.

Preferably, though not necessarily, the laundry washing machine is furthermore characterized in that the regeneration-agent reservoir is at least partly located/incorporated into the drawer-like supporting structure.

Preferably, though not necessarily, the laundry washing machine is furthermore characterized in that the regeneration-agent reservoir is housed into the drawer-like supporting structure in a manually removable manner.

Preferably, though not necessarily, the laundry washing machine is furthermore characterized in that the regeneration-agent reservoir comprises a substantially basin-shaped, regeneration-agent container which is manually fillable with a given quantity of consumable regeneration agent, and is located/incorporated into the drawer-like supporting structure so that the mouth of the basin-shaped container is freely accessible by the user when the drawer-like supporting structure is arranged in the extracted position, and is hidden and inaccessible by the user when the drawer-like supporting structure is arranged in the retracted position.

Preferably, though not necessarily, the laundry washing machine is furthermore characterized in that the water supply circuit of the water softening device is structured for spilling/pouring a shower of the water droplets by gravity into the substantially basin-shaped container of the regeneration-agent reservoir when the drawer-like supporting structure is arranged in the retracted position.

Preferably, though not necessarily, the laundry washing machine is furthermore characterized in that the regeneration-agent reservoir comprises: a storage tank which is structured for being manually fillable with a given quantity of consumable regeneration agent, and is housed into the drawer-like supporting structure so to be freely accessible by the user when the drawer-like supporting structure is in the extracted position, and to be hidden and inaccessible by the user when the drawer-like supporting structure is arranged in the retracted position; and a manually-removable cap which is structured to closed the storage tank.

Preferably, though not necessarily, the laundry washing machine is furthermore characterized in that the water supply circuit of the water softening device is structured for channelling the fresh water directly into the storage tank, so as to substantially dissolve the regeneration agents contained into the storage tank and form brine.

Preferably, though not necessarily, the laundry washing machine is furthermore characterized in that the storage tank is housed into the drawer-like supporting structure in a manually removable manner.

Preferably, though not necessarily, the laundry washing machine is furthermore characterized in that the storage tank of the regeneration-agent reservoir is recessed in manually extractable manner into a corresponding tank seat realized on the drawer-like supporting structure, and is provided with at least two self-closing hydraulic connectors which are structured to substantially watertight couple in easily detachable manner with corresponding complementary self-closing hydraulic connectors arranged on the drawer-like supporting structure; a first self-closing complementary hydraulic connector being in direct communication with a water supply circuit of the internal water softening device; a second self-closing complementary hydraulic connector being in direct communication with the water-softening agent container.

Preferably, though not necessarily, the laundry washing machine is furthermore characterized in that said at least two self-closing hydraulic connectors are structured to couple with the corresponding complementary self-closing hydraulic connectors arranged on the drawer-like supporting structure during insertion of the storage tank into the tank seat.

Preferably, though not necessarily, the laundry washing machine is furthermore characterized in that the bottom of the tank seat is shaped/structured so as to form a leakage collector wherein the fresh water or brine leaking out of the storage tank may accumulate; and in that said leakage collector realized on the bottom of said tank seat is connected via a water drain line to the washing tub or to the waste-water drain line that channels the waste water or washing liquor out of the laundry washing machine.

Preferably, though not necessarily, the laundry washing machine is furthermore characterized in that the regeneration-agent reservoir furthermore comprises a water-level sensor which is located on the bottom of the tank seat and is able to measure the level of the fresh water and/or brine accumulated on the leakage collector formed on the bottom of the tank seat.

Preferably, though not necessarily, the laundry washing machine is furthermore characterized in that the water softening device furthermore comprises a water-level sensor which is structured for measuring the level of the fresh water and/or brine contained inside the regeneration-agent reservoir, and/or a salinity-level sensor which is structured for measuring the salinity degree of the brine contained inside the regeneration-agent reservoir.

Preferably, though not necessarily, the laundry washing machine is furthermore characterized by also comprising a water drain line which is structured for selectively rerouting the brine or fresh water coming out from the water-softening agent container, directly towards the washing tub or towards the waste-water drain line that channels the waste water or washing liquor out of the laundry washing machine, so as to bypass the detergent dispensing assembly.

Preferably, though not necessarily, the laundry washing machine is furthermore characterized by also comprising a second fresh-water supply circuit which is connected to the water mains independently from the main fresh-water supply circuit, and is structured for selectively channelling the fresh water from the water mains to the detergent dispensing assembly and/or to the washing tub, while bypassing the water softening device.

Preferably, though not necessarily, the laundry washing machine is furthermore characterized in that said appliance control panel is structured so as to allow the user to manually select the desired washing cycle between washing cycles that use softened fresh water, washing cycles that use non-softened fresh water, and washing cycles that use a mixture of softened and non-softened fresh water.

Preferably, though not necessarily, the regeneration-agent reservoir furthermore comprises an overflow drain line 55 which fluidically connects the storage tank to the washing tub, and is structured for directly channelling the water or brine eventually exceeding the maximum capacity of the storage tank towards the washing tub.

BRIEF DESCRIPTION OF THE DRAWINGS

A non-limiting embodiment of the present invention will now be described, by way of example, with reference to the accompanying drawings, in which:

FIG. 9 is a partial and schematic view of a portion of the internal water softening device of the FIG. 7 laundry washing machine; whereas

DETAILED DESCRIPTION OF EXAMPLE EMBODIMENTS

Figure 2:
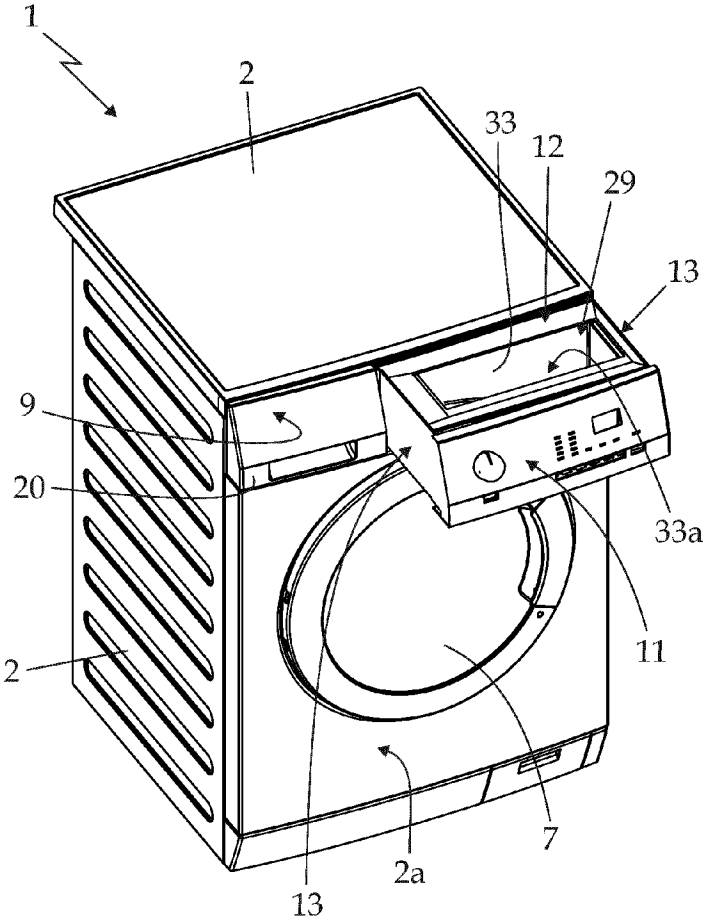
FIG. 2 is a perspective view of the FIG. 1 laundry washing machine in different working configuration.
Figure 1:
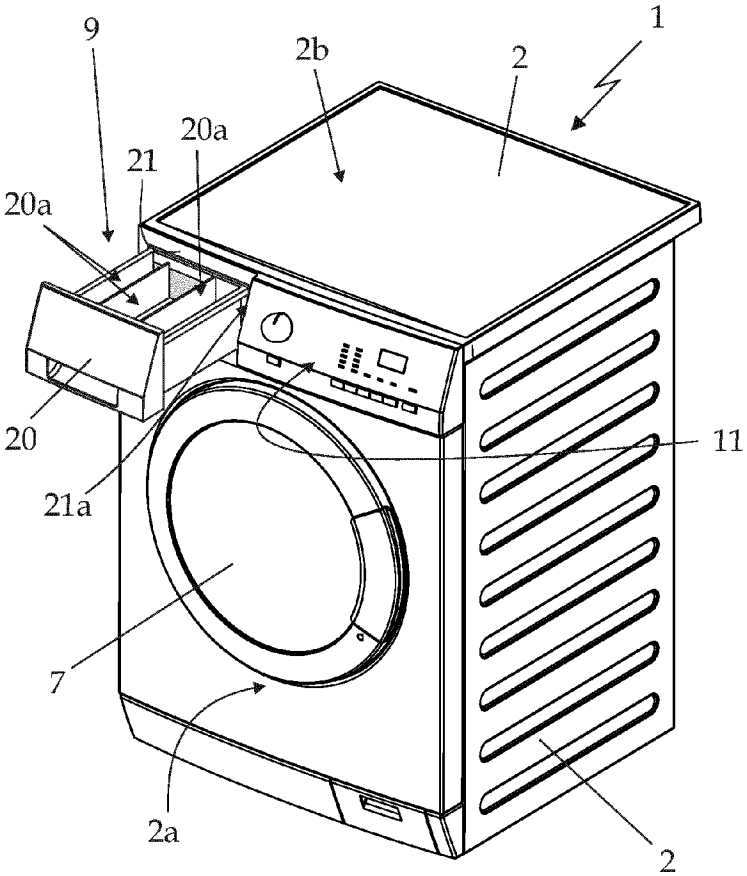
FIG. 1 is a perspective view of a front-loading, home laundry washing machine realized in accordance with the teachings of the present invention.
Figure 3:
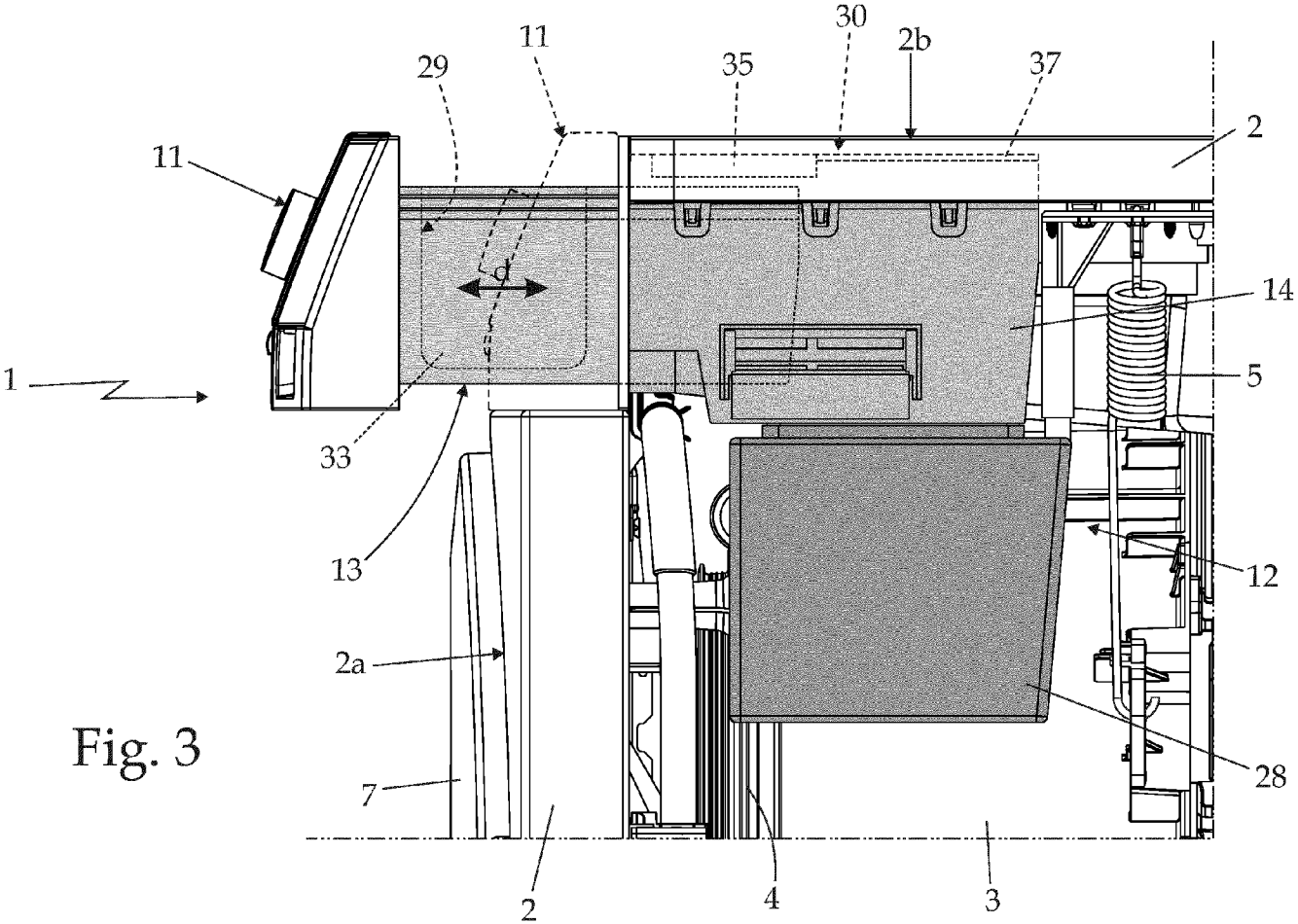
FIG. 3 is a side view of the FIG. 1 laundry washing machine with parts removed for clarity and partly disclosing the internal water softening device of the washing machine.

With reference to FIGS. 1, 2 and 3, reference number 1 indicates as a whole a home laundry washing machine which comprises: a preferably, though not necessarily, substantially parallelepiped-shaped, rigid outer boxlike casing 2 which is structured for resting on the floor; a preferably substantially cylindrical, bell-shaped hollow washing tub 3 which is arranged inside the casing 2 with its opening or mouth directly facing a laundry loading/unloading through opening realized in the front wall 2*a* of boxlike casing 2; a preferably substantially cylindrical, elastically-deformable bellows 4 watertight connecting the front opening or mouth of washing tub 3 to the laundry loading/unloading opening realized in the front wall 2*a* of casing 2; and a substantially cylindrical, bell-shaped rotatable drum (not shown) structured for housing the laundry to be washed, and which is housed in axially rotatable manner inside the washing tub 3 so as to be able to freely rotate about its longitudinal reference axis.

In the example shown, in particular, the laundry loading/unloading opening is preferably realized on front wall 2*a* of casing 2 substantially astride of the vertical center-plane of the casing 2, and the washing tub 3 is preferably arranged inside the boxlike casing 2 with its longitudinal reference axis substantially horizontally-oriented, i.e. substantially perpendicular to front wall 2*a*. The rotatable drum (not shown), in turn, is housed in axially rotating manner inside the washing tub 3 with its front opening directly faced/aligned to the laundry loading/unloading opening on front wall 2*a*, and the drum rotation axis is preferably arranged locally substantially coincident with the substantially horizontally-oriented longitudinal reference axis of washing tub 3.

Furthermore in the example shown the hollow washing tub 3 is preferably suspended in floating manner inside the casing 2 via a suspension system preferably, though not necessarily, comprising a couple of upper coil springs 5 connecting the upper portion of the washing tub 3 to the top of the boxlike casing 2, and a number of lower vibration dampers (not shown) connecting the bottom portion of the washing tub 3 to the bottom of casing 2.

With reference to FIGS. 1, 2, 3 and 4, the laundry washing machine 1 furthermore comprises:

- a porthole door 7 which is hinged to the front wall 2*a* of casing 2 to rotate about a preferably, though not necessarily, vertically-oriented reference axis to and from a closing position in which the peripheral border of the porthole door 7 rests completely on front wall 2*a* for closing the laundry loading/unloading opening and watertight sealing the washing tub 3;
- an electrically-powered motor assembly (not shown) which is structured for driving into rotation the rotatable drum about its longitudinal reference axis inside the washing tub 3;
- a detergent dispensing assembly 9 which is housed inside the casing 2 in easily reachable manner by the user, and is structured for selectively feeding into the washing tub 3, according to the selected washing cycle, a given amount of detergent, softener and/or other washing agent preferably suitably mixed with the fresh water arriving from the water mains, or even simply a given amount of fresh water arriving from the water mains; and
- a fresh-water supply circuit 10 which is structured for being connected to the water mains and for selectively channeling the fresh water from the water mains to the detergent dispensing assembly 9 and/or to the washing tub 3 preferably while controlling/regulating the flow of fresh water towards the detergent dispensing assembly 9 and/or the washing tub 3.

In addition to the above, the laundry washing machine 1 furthermore comprises an appliance control panel 11 which is structured for allowing the user to manually select the desired washing-cycle and is moreover located on front wall 2*a* of casing 2, above the laundry loading/unloading opening and preferably also immediately beneath the top of casing 2; and an internal water softening device 12 which is located inside the casing 2, and is structured for selectively reducing, during each washing cycle, the hardness degree of the fresh water flowing from the water mains to the detergent dispensing assembly 9 and/or to the washing tub 3.

More specifically, the internal water softening device 12 is arranged/located along the fresh-water supply circuit 10, so as to be crossed by the fresh water flowing from the water mains to the detergent dispensing assembly 9 and/or the washing tub 3, and it is internally provided with a given amount of water softening agent which is able to reduce the hardens degree of the fresh water flowing through the same water softening device 12, and with a given amount of consumable salt or other regeneration agent which is able to regenerate the water softening function of the water softening agent.

With reference to FIGS. 1, 2 and 3, in particular, the appliance control panel 11 is located/arranged on a front side of a drawer-like supporting structure 13 which is fitted/inserted in manually extractable manner into the front wall 2*a* of casing 2, preferably between the laundry loading/unloading opening on front wall 2*a* and the top wall 2*b* of casing 2, so as to be movable in a preferably substantially horizontally-oriented, displacement direction d between

- a retracted position (see FIG. 1) in which the drawer-like supporting structure 13 is completely recessed into the front wall 2*a* of casing 2, and the appliance control panel 11 is arranged substantially coplanar to the front wall 2*a* of casing 2; and
- a completely extracted position (see FIGS. 2 and 3) in which the drawer-like supporting structure 13 partly juts out from the front wall 2*a* of casing 2, and the appliance control panel 11 is forward spaced apart from the front wall 2*a* of casing 2.

In the example shown, in particular, the drawer-like supporting structure 13 is preferably fitted/inserted in manually extractable manner into a completely recessed, drawer housing 14 which, starting from front wall 2*a* of casing 2, extends preferably substantially horizontally inside the boxlike casing 2 while remaining above the washing tub 3, and communicates with the outside of casing 2 via a front entrance or opening 14*a* realized on front wall 2*a* of casing 2 immediately above the laundry loading/unloading opening.

The drawer-like supporting structure 13 carrying the appliance control panel 11 is therefore manually movable inside the drawer housing 14 in a preferably substantially horizontally-oriented, displacement direction d between

- a retracted position (see FIG. 1) in which the drawer-like supporting structure 13 is completely recessed inside the drawer housing 14, and the appliance control panel 11 is substantially coplanar to the front wall 2*a* of casing 2 and closes the front entrance or opening 14*a* of drawer housing 14; and
- a completely extracted position (see FIGS. 2 and 3) in which the drawer-like supporting structure 13 partly juts out from the front wall 2*a* of casing 2 through the front entrance or opening 14*a* of drawer housing 14, and the appliance control panel 11 is forward spaced apart from the front wall 2*a* of casing 2.

In the example shown, in particular, the drawer housing 14 is preferably arranged inside the casing 2 so as to locate its front entrance or opening 14*a* substantially on the upper left corner of the front wall 2*a*, immediately beneath the top of boxlike casing 2; whereas the drawer-like supporting structure 13 is preferably movable inside the drawer housing 14 along a substantially horizontally-oriented, displacement direction d which is also locally substantially perpendicular to the front wall 2*a* of casing 2.

With reference to FIGS. 1, 2, 3 and 4, the internal water softening device 12, in turn, is provided with an exposable loading inlet or mouth which is structured for allowing the user to timely load the consumable salt or other regeneration agent inside the same internal water softening device 12, and it is moreover at least partly arranged/located on the drawer-like supporting structure 13 of the appliance control panel 11 so that the loading inlet or mouth of the same water softening device 12 is freely accessible by the user when the drawer-like supporting structure 13 is arranged in the completely extracted position (see FIGS. 2 and 3), and is completely hidden and inaccessible by the user when the drawer-like supporting structure 13 is arranged in the retracted position (see FIG. 1).

Figure 4:
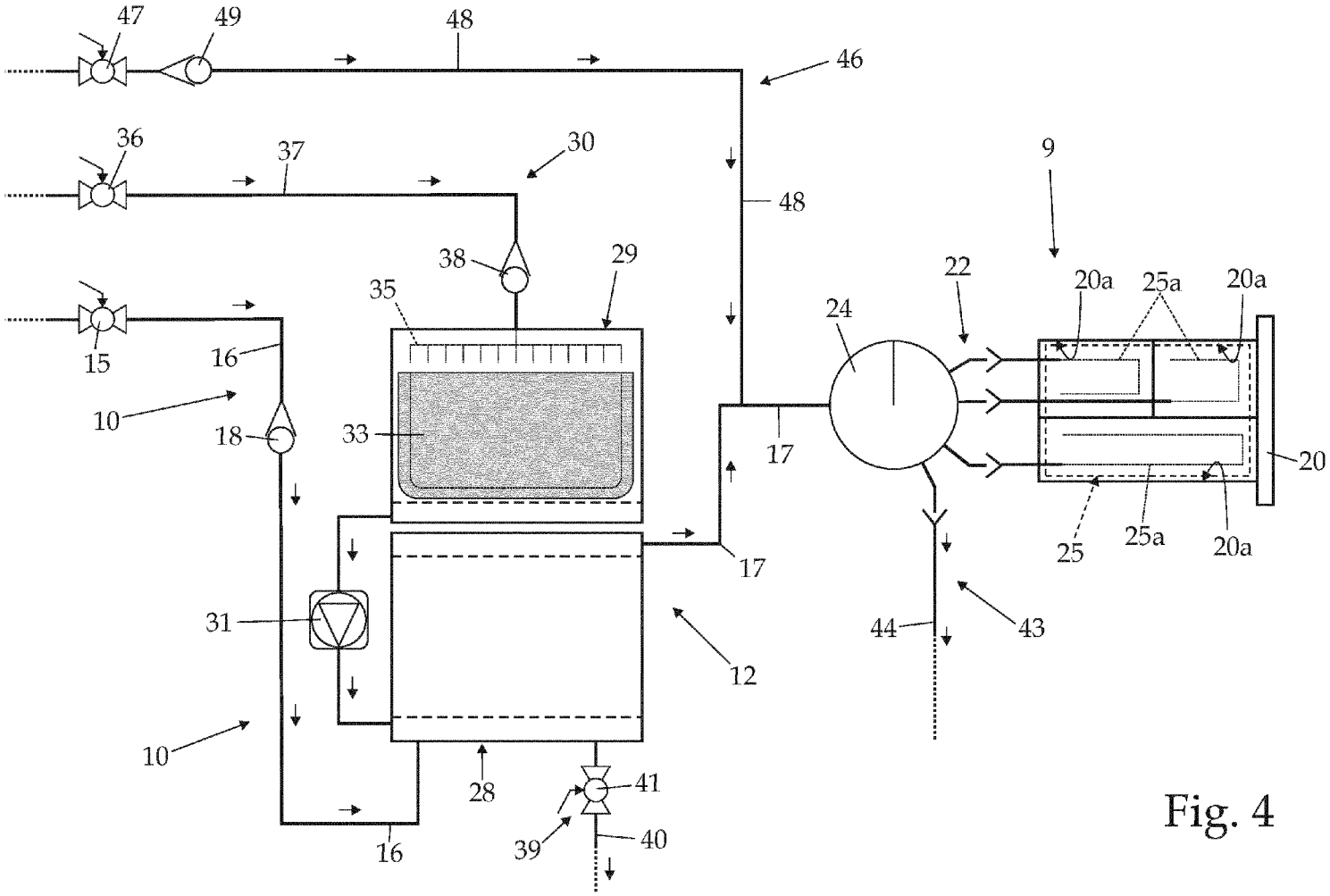
FIG. 4 is a schematic view of the internal water softening device of the FIG. 1 laundry washing machine, with parts removed for clarity.

With reference to FIG. 4, in the example shown, in turn, the fresh-water supply circuit 10 preferably comprises an electrically-controlled on-off valve 15 which is arranged/interposed between the water mains and the water softening device 12, and is able to control/regulate the flow of fresh water from the water mains towards the water softening device 12; a first pipeline 16 connecting the on-off valve 15 directly to the inlet of the internal water softening device 12; and a second pipeline 17 connecting the outlet of the internal water softening device 12 to the detergent dispensing assembly 9 and/or to the washing tub 3. Preferably, though not necessarily, the electrically-controlled on-off valve 15 is moreover attached to the rear wall of casing 2.

Furthermore the fresh-water supply circuit 10 is preferably also provided with a one-way valve 18 which is located along pipeline 16 immediately downstream of the on-off valve 15, i.e. between the on-off valve 15 and the inlet of the water softening device 12, and is arranged so to allow the fresh water to only flow along the pipeline 16 from the water mains to the water softening device 12 and not vice versa. The internal water softening device 12 is therefore located downstream of the electrically-controlled on-off valve 15, and also downstream of the one-way valve 18 if present.

With reference to FIGS. 1, 2 and 4, similarly to the internal water softening device 12, the detergent dispensing assembly 9 is provided with a corresponding loading inlet or mouth which is exposable to the outside preferably on the front wall 2*a* of casing 2, and is structured for allowing the user to timely load the requested detergent, softener and/or other washing agent inside the same detergent dispensing assembly 9. Preferably the detergent dispensing assembly 9 is furthermore arranged inside the boxlike casing 2 so that its loading inlet or mouth is located on front wall 2*a* of casing 2, beside the drawer-like supporting structure 13 carrying the appliance control panel 11, i.e. beside the front entrance or opening 14*a* of drawer housing 14.

In other words, the detergent dispensing assembly 9 is preferably housed inside the boxlike casing 2 between the washing tub 3 and the top wall of casing 2, so as to emerge from the front wall 2*a* of boxlike casing 2 above the laundry loading/unloading opening of casing 2, and beside the appliance control panel 11.

In the example shown, in particular, the detergent dispensing assembly 9 is preferably arranged inside casing 2 so as to locate its loading inlet or mouth substantially on the upper right corner of front wall 2*a*.

Thus the detergent dispensing assembly 9 and the water softening device 12 are preferably arranged inside the boxlike casing 2 substantially horizontally aligned to one another, so that the corresponding loading inlets or mouths are both arranged on front wall 2*a* above the laundry loading/unloading opening of casing 2 and immediately beneath the top of casing 2.

With reference to FIGS. 1, 2 and 4, in the example shown, in particular, the detergent dispensing assembly 9 preferably comprises a detergent container 20 which is manually fillable with a given quantity of detergent, softener and/or other washing agent, and is housed inside the casing 2 into a corresponding container housing 21; and the front wall 2*a* of casing 2 is preferably provided with a corresponding pass-through opening 21*a* through which the detergent container 20 is accessible by the user.

In other words, the detergent container 20 is provided with a loading inlet or mouth which is structured for allowing the user to load the requested detergent, softener and/or other washing agent inside the same detergent container 20, and this loading inlet or mouth is accessible by the user through the pass-through opening 21*a* on front wall 2*a*.

The quantity of detergent, softener and/or other washing agent stored into the detergent container 20 may be sufficient either for a single washing cycle or for several consecutive washing cycles.

With reference to FIG. 4, preferably, though not necessarily, the detergent dispensing assembly 9 furthermore comprises a water supply circuit 22 which is connected to the fresh-water supply circuit 10 downstream of the water softening device 12, and is structured for selectively channelling a given amount of fresh water arriving from the water mains into the detergent container 20, so as to selectively flush/push a given quantity of the detergent, softener or other washing agent into the washing tub 3.

More specifically, the inlet of water supply circuit 22 of detergent dispensing assembly 9 is fluidically connected to the fresh-water supply circuit 10, namely to the pipeline 17 of the fresh-water supply circuit 10, so as to receive the fresh water drawn from the water mains, and the water softening device 12 is located upstream of the water supply circuit 22 so as to be crossed by the fresh water flowing towards the water supply circuit 22.

In the example shown, in particular, the detergent dispensing assembly 9 preferably comprises a detergent drawer 20 which is manually fillable with a given quantity of detergent, softener and/or other washing agent, and which is fitted/inserted in manually extractable manner into a completely recessed drawer housing 21 which, starting from front wall 2*a* of casing 2, extends preferably substantially horizontally inside the boxlike casing 2 while remaining above the washing tub 3, and moreover communicates with the outside of casing 2 via a front entrance or opening 21*a* realized on front wall 2*a* of casing 2 immediately above the laundry loading/unloading opening. Preferably the bottom of drawer housing 21 is furthermore structured so to directly communicate with the inside of washing tub 3 via a corresponding connecting duct (not shown).

The detergent drawer 20 is therefore manually movable inside the drawer housing 21 in a preferably substantially horizontally-oriented, displacement direction between a working position (see FIG. 2) in which the detergent drawer 20 is completely recessed inside the corresponding drawer housing preferably while at same time closing the front entrance or opening of the same drawer housing, and a completely extracted position (see FIG. 1) in which the detergent drawer 20 partly juts out from the front wall 2*a* of casing 2 through the front entrance or opening 21*a* of the corresponding drawer housing 21.

In the example shown, in particular, the drawer housing 21 of detergent drawer 20 is preferably arranged inside casing 2 so as to locate its front entrance or opening 21*a* substantially on the upper right corner of front wall 2*a* of casing 2; whereas the detergent drawer 20 is preferably movable inside the same drawer housing 21 along a substantially horizontally-oriented, displacement direction which is also locally substantially perpendicular to front wall 2*a* of casing 2.

With reference to FIG. 4, the water supply circuit 22, in turn, is connected to the fresh-water supply circuit 10 downstream of the water softening device 12, and is structured for selectively spilling/pouring a given amount of fresh water arriving from the water mains into the detergent drawer 20, so as to selectively flush a given quantity of the detergent, softener or other washing agent into the washing tub 3.

In the example shown, in particular, the water supply circuit 22 receives the fresh water from the fresh-water supply circuit 10, and is preferably structured for selectively spilling/pouring a shower of water droplets by gravity directly into the detergent drawer 20, so as to flush the detergent, softener or other washing agent out of the detergent drawer 20 and down onto the bottom of drawer housing 21. This mixture of water and detergent, softener or other washing agent afterwards flows into washing tub 3 via the connecting duct branching off from the bottom of the drawer housing 21 of detergent drawer 20.

In addition to the above, with reference to FIG. 4, the detergent drawer 20 is preferably, though not necessarily, divided into a plurality of detergent compartments 20*a* (three detergent compartments in the example shown) each of which is manually fillable with a respective washing agent; and the water supply circuit 22 is structured for spilling/pouring the softened fresh water arriving from the fresh-water supply circuit 10 selectively and alternatively into any one of the detergent compartments 20*a* of detergent drawer 20, so as to selectively flush the detergent, softener or other washing agent out of the same compartment 20*a* and down onto the substantially funnel-shaped bottom of drawer housing 21 of detergent drawer 20.

With reference to FIG. 4, in the example shown, in particular, the water supply circuit 22 of detergent dispensing assembly 9 is provided with an electrically-controlled hydraulic distributor 24 or similar valve assembly, which is arranged/interposed between the fresh-water supply circuit 10 and the various detergent compartments 20*a* of the detergent drawer 20, i.e. between the outlet of the pipeline 17 and the various detergent compartments 20*a* of detergent drawer 20, and is structured for selectively and alternatively channeling the fresh water arriving from the fresh-water supply circuit 10 towards the various detergent compartments 20*a* of detergent drawer 20.

More specifically, in the example shown the water supply circuit 22 is preferably, though not necessarily, structured for spilling/pouring a shower of water droplets by gravity into the various detergent compartments 20*a* of the detergent drawer 20.

In other words, with reference to FIG. 4, in the example shown the water supply circuit 22 preferably comprises a sprinkler head 25 which is associated to the drawer housing 21 of detergent drawer 20 so as to be located immediately above the detergent drawer 20 when the latter is completely inserted/recessed into the same drawer housing. This sprinkler head 25 is provided with a number (three in the example shown) of shower-making portions/sections 25*a* each of which is preferably substantially vertically aligned to one or more detergent compartments 20*a* of detergent drawer 20, and is structured for feeding a shower of water droplets by gravity into said detergent compartment/s 20*a*.

In the example shown, in particular, each shower-making section/portion 25*a* of sprinkler head 25 is preferably locally vertically aligned to a respective detergent compartment 20*a* of detergent drawer 20, and is preferably structured for feeding a shower of water droplets exclusively into the detergent compartment 20*a* located immediately beneath.

The electrically-controlled hydraulic distributor or valve assembly 24 is located upstream of the sprinkler head 25, i.e. between the sprinkler head 25 and the fresh-water supply circuit 10, and is structured for channeling the fresh water arriving from the fresh-water supply circuit 10 selectively and alternatively towards the various shower-making sections/portions 25*a* of the sprinkler head 25.

In other words, the electrically-controlled hydraulic distributor 24 is provided with a water inlet fluidically connected to the fresh-water supply circuit 10, i.e. to pipeline 17, and a number (three in the example shown) of water outlets each fluidically connected to a respective shower-making section/portion 25*a* of the sprinkler head 25, and it is structured for selectively and alternatively channeling the fresh water arriving from the fresh-water supply circuit 10 to the various shower-making sections/portions 25*a* of the sprinkler head 25.

With reference to FIGS. 2, 3 and 4, the internal water softening device 12 in turn basically comprises a water-softening agent container 28 and a regeneration-agent reservoir 29, both housed inside the boxlike casing 2.

The water-softening agent container 28 is arranged/located along the fresh-water supply circuit 10 so as to be crossed by the fresh water flowing along the fresh-water supply circuit 10, and is filled with a water softening agent able to reduce the hardness degree of the fresh water flowing through the same water-softening agent container 28. The regeneration-agent reservoir 29 instead is structured for receiving a given quantity of consumable salt or other regeneration agent which is able to regenerate the water softening function of the water softening agents stored inside the water-softening agent container 28, and is fluidically connected to the water-softening agent container 28 for selectively transferring a mixture of water and salt or other regeneration agent to the water-softening agent container 28.

In the example shown, in particular, the water-softening agent container 28 has an inlet connected to pipeline 16 of fresh-water supply circuit 10 and an outlet connected to pipeline 17 of fresh-water supply circuit 10, so as to be crossed by the fresh water flowing from the water mains to the detergent dispensing assembly 9. The water-softening agent container 28 is therefore fluidically interposed between the water mains and the detergent dispensing assembly 9, or more specifically between the water mains and the inlet of the water supply circuit 22 of detergent dispensing assembly 9, so as to be crossed by the fresh water flowing from the water mains to the inlet of water supply circuit 22.

With reference to FIGS. 2, 3 and 4, the regeneration-agent reservoir 29, in turn, is provided with an exposable loading inlet or mouth which is structured for allowing the user to timely load the consumable salt or other regeneration agent inside the same regeneration-agent reservoir 29 thus forming the exposable loading inlet or mouth of the internal water softening device 12, and it is moreover at least partly located/incorporated into the drawer-like supporting structure 13 carrying the appliance control panel 11 so that the loading inlet or mouth of the same regeneration-agent reservoir 29 is freely accessible by the user when the drawer-like supporting structure 13 is arranged in the completely extracted position (see FIGS. 2 and 3), and is completely hidden and inaccessible by the user when the drawer-like supporting structure 13 is arranged in the retracted position (see FIG. 1).

In other words, the regeneration-agent reservoir 29 is at least partly located/incorporated into the drawer-like supporting structure 13 of the appliance control panel 11, so that both detergent dispensing assembly 9 and regeneration-agent reservoir 29 are selectively exposable to the outside on front wall 2*a* of casing 2 one horizontally spaced beside the other, for being independently accessible by the user at any moment.

With reference to FIGS. 3 and 4, in the example shown, in particular, the water-softening agent container 28 is filled with a given amount of ion-exchange resins (not shown) capable to restrain the calcium and/or magnesium ions (Ca++ an Mg++) dissolved in the fresh water flowing across the same water-softening agent container 28, and is located along the fresh-water supply circuit 10 so as to be crossed by the fresh water directed towards the detergent dispensing assembly 9 and/or the washing tub 3.

The outside-accessible regeneration-agent reservoir 29, in turn, is structured for receiving a given amount (for example half a Kilo or one Kilo) of salt grains (Sodium Chloride) or similar regeneration chemical agent, and is located/incorporated into the drawer-like supporting structure 13 carrying the appliance control panel 11, so as to be freely accessible by the user when the drawer-like supporting structure 13 is arranged in the completely extracted position (see FIGS. 2 and 3), and to be completely hidden and inaccessible by the user when the drawer-like supporting structure 13 is arranged in the retracted position (see FIG. 1).

More in particular, the water-softening agent container 28, hereinafter also referred to as the resin container 28, is preferably arranged between pipelines 16 and 17, so as to be crossed by the fresh water directed towards the detergent dispensing assembly 9 and/or the washing tub 3, and it is furthermore arranged upstream of the hydraulic distributor 24 of detergent dispensing assembly 9, so as to be crossed by the fresh water flowing from the water mains to the inlet of water supply circuit 22. The ion-exchange resins (not shown) stored into the water-softening agent container 28 form the water softening agents of the water softening device 12.

Furthermore, in the example shown the water-softening agent container 28 is preferably located immediately beneath the drawer-like supporting structure 13 carrying the appliance control panel 11, or more precisely immediately beneath the drawer housing 14 of the drawer-like supporting structure 13, so as to be substantially vertically aligned to the regeneration-agent reservoir 29 when the drawer-like supporting structure 13 is arranged in the retracted position.

With reference to FIG. 4, in addition to the above the internal water softening device 12 furthermore comprises:

- a water supply circuit 30 which is structured for channelling, on command, a given amount of fresh water into the regeneration-agent reservoir 29 so to at least partly dissolve the salt or other regeneration agents stored therein and form a given amount of brine (i.e. of salt water); and
- an electrically-powered brine-circulating pump 31 which is interposed between the water-softening agent container 28 and the regeneration-agent reservoir 29 and is structured for transferring/moving, when activated, the brine (i.e. the salt water) from the regeneration-agent reservoir 29 to the water-softening agent container 28.

Preferably, the electrically-powered brine-circulating pump 31 is furthermore structured for transferring/moving, when activated, the brine (i.e. the salt water) from the regeneration-agent reservoir 29 to the water-softening agent container 28, and for completely watertight sealing/isolating, when deactivated, the regeneration-agent reservoir 29 from the water-softening agent container 28 so as to prevent the brine (i.e. the salt water) store in the regeneration-agent reservoir 29 from flowing towards the water-softening agent container 28.

Obviously, in a less sophisticated embodiment, the electrically-powered brine-circulating pump 31 may be replaced by an electrically-powered pump assembly comprising a conventional electrically-powered suction pump and an on-off valve which is arranged immediately upstream of the suction pump and is structured to watertight seal the suction/inlet of the electrically-powered suction pump when the latter is deactivated, and to put the suction/inlet of the electrically-powered suction pump in direct communication with the inside of the regeneration-agent reservoir 29 when the suction pump is activated.

Preferably, the water softening device 12 is furthermore provided with a water-level sensor (not shown) which is structured for measuring the level of the brine contained into the regeneration-agent reservoir 29, and/or a salinity-level sensor (not shown) which is structured for measuring the salinity degree of the brine contained into the regeneration-agent reservoir 29.

In the example shown, in particular, the water-level sensor and/or the salinity-level sensor is/are able to communicate with an internal electronic central control unit (not shown) which is housed inside the boxlike casing 2 and controls all electrically-operated component parts of the laundry washing machine 1.

With reference to FIGS. 2, 3 and 4, in the example shown, in particular, the regeneration-agent reservoir 29 preferably comprises a substantially basin-shaped, regeneration-agent container 33 which is manually fillable with a given quantity of consumable salt or other regeneration agent, and is moreover located/incorporated into the drawer-like supporting structure 13 of the appliance control panel 11, so that the upper mouth 33*a* of the basin-shaped container 33 is freely accessible by the user when the drawer-like supporting structure 13 is arranged in the completely extracted position (see FIGS. 2 and 3), and is completely hidden and inaccessible by the user when the drawer-like supporting structure 13 is arranged in the retracted position (see FIG. 1).

The water supply circuit 30, in turn, is structured for channelling, on command, a given amount of fresh water into the basin-shaped container 33 so to at least partly dissolve the salt or other regeneration agents stored therein and form a given amount of brine (i.e. of salt water).

Being freely accessible by the user, the upper mouth 33*a* of the basin-shaped container 33 allows the user to load the consumable salt or other regeneration agent inside the regeneration-agent reservoir 29, and therefore forms the exposable loading inlet or mouth of the water softening device 12.

The bottom portion of the drawer housing 14 of the drawer-like supporting structure 13, in turn, is preferably, though not necessarily, shaped/structured so as to form a catchment basin wherein the brine coming out of the basin-shaped container 33 accumulates, and the suction of the brine-circulating pump 31 directly communicates with the bottom of drawer housing 14, so that the brine-circulating pump 31 is able to selectively pump the brine from the bottom of drawer housing 14 to the resin container 28.

As an alternative, the bottom of the substantially basin-shaped, regeneration-agent container 33 may be directly connected to the suction of the brine-circulating pump 31 via a specific flexible hosepipe, so that the brine-circulating pump 31 is able to selectively pump the brine from the basin-shaped container 33 to the resin container 28.

Preferably, though not necessarily, the water softening device 12 furthermore comprises a water-level sensor (not shown) which is structured for measuring the level of the brine contained into the basin-shaped container 33, and/or a salinity-level sensor (not shown) which is structured for measuring the salinity degree of the brine contained into the basin-shaped container 33.

With reference to FIGS. 3 and 4, the water supply circuit 30 of water softening device 12, in turn, is preferably structured for being connected to the water mains independently from the fresh-water supply circuit 10, so as to be able to selectively draw a given amount of fresh water from the water mains and channel said fresh water directly into the regeneration-agent reservoir 29.

In the examples shown, in particular, the water supply circuit 30 is preferably connected to the water mains independently from the fresh-water supply circuit 10, and is preferably structured for spilling/pouring a shower of the water droplets by gravity directly into the basin-shaped container 33 when the drawer-like supporting structure 13 is arranged in the retracted position (see FIG. 1).

More in particular, with reference to FIGS. 3 and 4, similarity the water supply circuit 22, the water supply circuit 30 of water softening device 12 preferably comprises:

- a sprinkler head 35 which is associated to the drawer housing 14 so as to be located immediately above the basin-shaped container 33 of the regeneration-agent reservoir 29 when the drawer-like supporting structure 13 is arranged in the retracted position, and it is provided with a shower-making portion/section which preferably, though not necessarily, extends above the whole basin-shaped container 33, and is structured for feeding a shower of water droplets by gravity into the basin-shaped container 33; and
- an electrically-controlled on-off valve 36 which is arranged/interposed between the water mains and the sprinkler head 35, and is able to control/regulate the flow of fresh water from the water mains towards the sprinkler head 35.

In the example shown, in particular, the electrically-controlled on-off valve 36 is preferably, though not necessarily, attached to the rear wall of casing 2 close to on-off valve 15, and it is directly connected to the sprinkler head 35 via a pipeline 37 or the like.

The electrically-controlled on-off valve 36 is furthermore preferably, though not necessarily, dimensioned so as to have a nominal flow rate substantially equal to the nominal flow rate of the brine-circulating pump 31, so that the brine-circulating pump 31 is able to transfer/move the brine little by little from the regeneration-agent reservoir 29 to the resin container 28, thus minimising the permanency of the brine on the bottom of either the basin-shaped container 33 or the drawer housing 14.

With reference to FIG. 4, preferably, though not necessarily, the water supply circuit 30 of water softening device 12 furthermore comprises an additional one-way valve 38 which is located immediately downstream of the on-off valve 36, i.e. between the on-off valve 37 and the sprinkler head 35, and which is arranged so to allow the fresh water to only flow along pipeline 37 from the water mains to the sprinkler head 35.

With reference to FIGS. 3 to 4, the resin container 28, in turn, is preferably, though not necessarily, attached to the bottom of the drawer housing 14 of the drawer-like supporting structure 13 immediately beside the upper portion of washing tub 3, so as to internally face the front wall 2*a* of casing 2.

In other words, the resin container 28 is preferably located below the drawer housing 14 of the drawer-like supporting structure 13 carrying the appliance control panel 11, within an approximately triangular pocket seat or compartment delimited by the sidewall of the boxlike casing 2, the upper portion of the washing tub 3 and the front wall 2*a* of casing 2.

Moreover, the resin container 28 preferably, though not necessarily, includes a completely stand-alone modular cartridge 28 which is provided with mechanical coupling members (not shown) structured for allowing a rigid and stable, though easily releasable, fastening of the stand-alone modular component-part or cartridge 28 directly to the bottom of the drawer housing 14 of the drawer-like supporting structure 13, and with hydraulic connectors (not shown) structured for allowing the stable, though easily removable, fluidical connection of the stand-alone modular cartridge 28 to the fresh water supply circuit 10 and to the outlet of the brine-circulating pump 31.

In other words, a first hydraulic connector (not shown) of the stand-alone modular cartridge 28 is connected to pipeline 16, so as to allow the inflow of the fresh water into the resin container 28; a second hydraulic connector (not shown) of the stand-alone modular cartridge 28 is connected to pipeline 17 so as to allow the outflow of the fresh water from the resin container 28 towards the detergent dispensing assembly 9; and a third hydraulic connector (not shown) of the stand-alone modular cartridge 28 is structured to directly communicate with the outlet of the brine-circulating pump 31 so as to allow the controlled inflow of the brine (i.e. the salt water) into the resin container 28.

With reference to FIG. 4, in the example shown the internal water softening device 12 is preferably, though not necessarily, also provided with a first water drain line 39 which fluidically connects the resin container 28, i.e. the water-softening agent container 28, to the washing tub 3 and is structured for selectively draining the brine or fresh water out of the resin container 28 and channelling said brine or fresh water directly into the washing tub 3.

As an alternative, the water drain line 39 is structured for channeling the brine or fresh water stored into the resin container 28 preferably into the drain sump (not shown) that extends downwards form the bottom of the washing tub 3, or into the water filtering assembly (not shown) that is interposed between the drain sump (not shown) of washing tub 3 and the suction of either the water circulating pump (not shown) or the water exhaust pump (not shown), or substantially directly into the water exhaust pump (not shown) which drains the waste water or washing liquor outside of the laundry washing machine 1, or in any case into the waste-water drain line that channels the waste water or washing liquor outside the laundry washing machine 1.

In the example shown, in particular, the water drain line 39 preferably comprises a pipeline 40 or the like which directly connects the bottom of the resin container 28 to the washing tub 3, or to the drain sump (not shown), or to the water filtering assembly (not shown), or to the water exhaust pump (not shown); and an electrically-controlled on-off valve 41 which is located along the pipeline 40 for controlling the outflow of the brine or fresh water from the resin container 28.

Lastly the internal water softening device 12 is preferably also provided with water-hardness sensor means (not shown) structured for measuring the hardness degree of the fresh water coming out from the resin container 28, i.e. the water-softening agent container 28, directed towards the detergent dispensing assembly 9.

In the example shown, in particular, the water-hardness sensor means are able to communicate with an internal electronic central control unit (not shown) which is housed inside the boxlike casing 2 and controls all electrically-operated component parts of the laundry washing machine 1.

Still with reference to FIG. 4, the laundry washing machine 1 is preferably, though not necessarily, also provided with a second water drain line 43 which is structured for selectively rerouting the brine or fresh water coming out from the resin container 28 directed towards the detergent dispensing assembly 9, into the washing tub 3 so as to bypass at least the detergent container 20, i.e. the detergent drawer 20, of the detergent dispensing assembly 9.

As an alternative, the water drain line 43 is structured for channeling the brine or fresh water coming out from the resin container 28 directed towards the detergent dispensing assembly 9 preferably into the drain sump (not shown) that extends downwards form the bottom of washing tub 3, or into the water filtering assembly (not shown) that is interposed between the drain sump (not shown) of washing tub 3 and the suction of the water circulating pump (not shown) and/or of the water exhaust pump (not shown) of the laundry washing machine 1, or in any case into the waste-water drain line that channels the waste water or washing liquor outside the laundry washing machine 1.

In the example shown, in particular, the second water drain line 43 is structured to selectively reroute the brine or fresh water that enters into the detergent dispensing assembly 9 through pipeline 17, directly towards the washing tub 3, or towards the drain sump (not shown) that extends downwards form the bottom of washing tub 3, or towards the water filtering assembly (not shown) that is interposed between the drain sump (not shown) of washing tub 3 and the suction of the water circulating pump (not shown) and/or of the water exhaust pump (not shown) of the laundry washing machine 1, so as to bypass solely the detergent container 20, i.e. the detergent drawer 20, of detergent dispensing assembly 9.

More in particular, with reference to FIG. 4, the second water drain line 43 preferably comprises a pipeline 44 or the like which is connected to a specific additional water outlet of the electrically-controlled hydraulic distributor 24 or similar valve assembly of the detergent dispensing assembly 9, and ends directly into the washing tub 3, or into the drain sump, or into the water filtering assembly, or into the water exhaust pump; and the electrically-controlled hydraulic distributor 24 is structured to selectively direct/channel directly into pipeline 44 the brine of softened fresh water arriving from resin container 28 via pipeline 17, so as to channel the brine or fresh water arriving from resin container 28 directly into the washing tub 3 or into the drain sump (not shown) or into the water filtering assembly (not shown) or into the water exhaust pump (not shown).

In a non-shown alternative embodiment, the second water drain line 43 of fresh-water supply circuit 10 may comprise, immediately upstream of the water supply circuit 22 of detergent dispensing assembly 9, an electrically-controlled three-way valve which has a first outlet connected to the inlet of the water supply circuit 22, i.e. to the hydraulic distributor 24, and a second outlet connected to pipeline 44 of water drain line 43. This electrically-controlled three-way valve is structured for selectively and alternatively channeling the fresh water coming out of the resin container 28 either to pipeline 44, or to the inlet of the water supply circuit 22 of detergent dispensing assembly 9, i.e. to the hydraulic distributor 24.

In this alternative embodiment, therefore, the second water drain line 43 is structured so as to bypass the whole detergent dispensing assembly 9, and therefore the water supply circuit 22 of detergent dispensing assembly 9 may lack the hydraulic distributor 24.

With reference to FIG. 4, preferably the laundry washing machine 1 is finally provided with a second fresh-water supply circuit 46 which is connectable to the water mains independently from the fresh-water supply circuit 10, and which is structured for selectively channelling the fresh water from the water mains to the detergent dispensing assembly 9 and/or directly to the washing tub 3, bypassing the water softening device 12, or better the of the resin container 28 of the water softening device 12.

In other words, the second fresh-water supply circuit 46 connects the water mains directly to the inlet of the water supply circuit 22 of detergent dispensing assembly 9 bypassing the water softening device 12, and is structured so as to selectively channel to the inlet of the water supply circuit 22 a second flow of non-softened fresh water of the water mains. The second fresh-water supply circuit 46 is therefore able to channel the fresh water of the water mains directly towards the inlet of water supply circuit 22 independently from the fresh-water supply circuit 10.

Furthermore, if the second water drain line 43 is present, the second fresh-water supply circuit 46 is preferably, though not necessarily, also able to channel the non-softened fresh water of the water mains directly to the washing tub 3 via the water drain line 43, thus bypassing all detergent compartments 20*a* of the detergent drawer 20.

With reference to FIG. 4, similarly to the fresh-water supply circuit 10, the second fresh-water supply circuit 46 preferably comprises:

- a electrically-controlled on-off valve 47 which is fluidically interposed between the water mains and the inlet of water supply circuit 22 of detergent dispensing assembly 9, and is able to control/regulate the flow of fresh water from the water mains towards the inlet of the water supply circuit 22; and
- a pipeline or the like 48 connecting the on-off valve 47 to the inlet of water supply circuit 22 of detergent dispensing assembly 9 while bypassing the resin container 28.

Furthermore the second fresh-water supply circuit 46 preferably also comprises a second one-way valve 49 which is located downstream of the on-off valve 47, and is arranged so to allow the fresh water to only flow along the pipeline 48, from the water mains to the inlet of the water supply circuit 20 of detergent dispensing assembly 9, and not vice versa.

Preferably, though not necessarily, the appliance control panel 11 is furthermore structured so as to allow the user to manually select the desired washing cycle between washing cycles that use softened fresh water, washing cycles that use normal, i.e. non-softened, fresh water, and finally washing cycles that use a mixture of softened and normal, i.e. non-softened, fresh water.

General operation of home laundry washing machine 1 is clearly inferable from the above description. When the on-off valve 15 of fresh-water supply circuit 10 is opened the fresh water flows from the water mains to the resin container 28 of internal water softening device 12, wherein the ion-exchange resins reduce the hardness degree of the fresh water directed to the detergent dispensing assembly 9. The water-hardness sensor means monitor the hardness degree of the fresh water directed to the detergent dispensing assembly 9.

After having crossed the resin container 28, the softened fresh water of the water mains reaches the detergent dispensing assembly 9 and enters into the electrically-controlled hydraulic distributor 24 of water supply circuit 22. According to phase of the washing cycle, the hydraulic distributor 24 then channels the softened fresh water to one or more of the shower-making portions/sections 25*a* of the sprinkler head 25 for flushing the detergent, softener or other washing agent out of the corresponding detergent compartment 20*a* of the detergent drawer 20 and sweeping away said detergent, softener or other washing agent down into the washing tub 3 via the connecting duct on the bottom of the drawer housing 21 of detergent drawer 20.

When determines that the ion-exchange resins inside the resin container 28 are no more able to reduce the hardness degree of the fresh water directed to the washing tub 3, the electronic central control unit (not shown) of laundry washing machine 1 performs, preferably immediately before the starting of the rinsing phase of the washing cycle, a regeneration process of the ion-exchange resins stored inside the resin container 28.

Obviously the regeneration process may also take place during the washing phase of the washing cycle, or can take place even when no washing cycle at all is running, preferably on specific request of the user.

At beginning of the regeneration process, the central control unit of laundry washing machine 1 firstly opens the on-off valve 36 of the water supply circuit 30 for enough time to channel into the regeneration-agent reservoir 29, i.e. into the basin-shaped container 33, an amount of fresh water sufficient to form, into the regeneration-agent reservoir 29, the whole amount of brine necessary for the resin regeneration process to take place.

During the preparation of the brine inside the regeneration-agent reservoir 29, the central control unit of laundry washing machine 1 can keep the on-off valve 15 of fresh-water supply circuit 10 either in the closed position or in the opened position according to current phase of the washing cycle.

When the requested amount of brine is formed into the regeneration-agent reservoir 29, the central control unit of laundry washing machine 1 closes the on-off valve 15 of the fresh-water supply circuit 10 to stop the flow of fresh water across the resin container 28, and preferably arranges the hydraulic distributor 24 of detergent dispensing assembly 9 so as to channel the fresh water arriving from the resin container 28 directly into the second water drain line 43.

Afterwards, the central control unit of laundry washing machine 1 activates the brine-circulating pump 31 to transfer/move the whole amount of brine at a time from the regeneration-agent reservoir 29 to the resin container 28. Since the resin container 28 is completely filled with the fresh water of the water mains, the brine entering into the resin container 28 pushes out of the resin container 28 the fresh water previously stored therein. This fresh water flows along pipeline 17 towards the hydraulic distributor 24 which, in turn, directs/channels said fresh water directly into the second water drain line 43.

In the example shown in particular, the brine accumulates either on the bottom of the basin-shaped container 33 or on the bottom portion of the drawer housing 14 of the drawer-like supporting structure 13, and the brine-circulating pump 31 sucks the brine from the bottom of either the drawer housing 14 or the basin-shaped container 33.

When resin container 28 is completely filled with a sufficient amount of brine, the central control unit of laundry washing machine 1 deactivates the brine-circulating pump 31 to watertight isolate the resin container 28 from the regeneration-agent reservoir 29, and to restrain the brine inside the resin container 28 for a predetermined time interval generally sufficient to allow the brine to remove from the ion-exchange resins the calcium and magnesium ions previously combined/fixed to said resins.

When the regeneration process of the ion-exchange resins is completed, the central control unit of laundry washing machine 1 opens again the on-off valve 15 of fresh-water supply circuit 10, so that the pressurized fresh water of the water mains pushes the brine out of the resin container 28 and into the pipeline 17 which channels the brine towards the hydraulic distributor 24 which, in turn, directs/channels said fresh water directly into the second water drain line 43.

Alternatively, the central control unit of laundry washing machine 1 may open the on-off valve 41 of the first water drain line 39 so to drain the brine out of the resin container 28 through the water drain line 39.

The brine stored in the resin container 28 therefore flows directly into the washing tub 3 or into the drain sump or into the water filtering assembly, or into the water exhaust pump, via the water drain line 39 and/or via the water drain line 43. Finally, preferably after having closed again the on-off valves 15 and 41, the central control unit of the laundry washing machine 1 activates the water exhaust pump so to discharge the brine out of the laundry washing machine 1 preferably together with the washing or rinsing water already stored on the bottom of the washing tub 3, and continues the washing cycle.

The second fresh-water supply circuit 46, in turn, can channel the fresh water of the water mains towards the inlet of water supply circuit 22 bypassing the water softening device 12, so to channel the non-softened fresh water of the water mains directly towards the inlet of the water supply circuit 22 of detergent dispensing assembly 9. The water supply circuit 22 of detergent dispensing assembly 9 therefore can channel towards any one of the detergent compartments 20*a* of detergent drawer 20, or towards the second water drain line 43 if connected to the hydraulic distributor 24, either softened, non-softened (i.e. normal) fresh water of the water mains or a mixture thereof.

The laundry washing machine 1 is therefore able to use, during each stage of the washing cycle, either softened or non-softened fresh water of the water mains or a mixture thereof. The second fresh-water supply circuit 46, in fact, can channel non-softened fresh water to the inlet of the water supply circuit 22 of detergent dispensing assembly 9 independently from the fresh-water supply circuit 10, thus also at the same time of the fresh-water supply circuit 10.

In a less sophisticated embodiment, however, the electronic central control unit of the laundry washing machine 1 may be programmed to regenerate the ion-exchange resins stored in the resin container 28 after a given number of washing cycles. This number of washing cycles may be decided by the user on the basis of an alleged hardness degree of the fresh water coming out from the water mains.

Obviously in this less sophisticated embodiment the water-hardness sensor means monitor are unnecessary.

Figure 5:
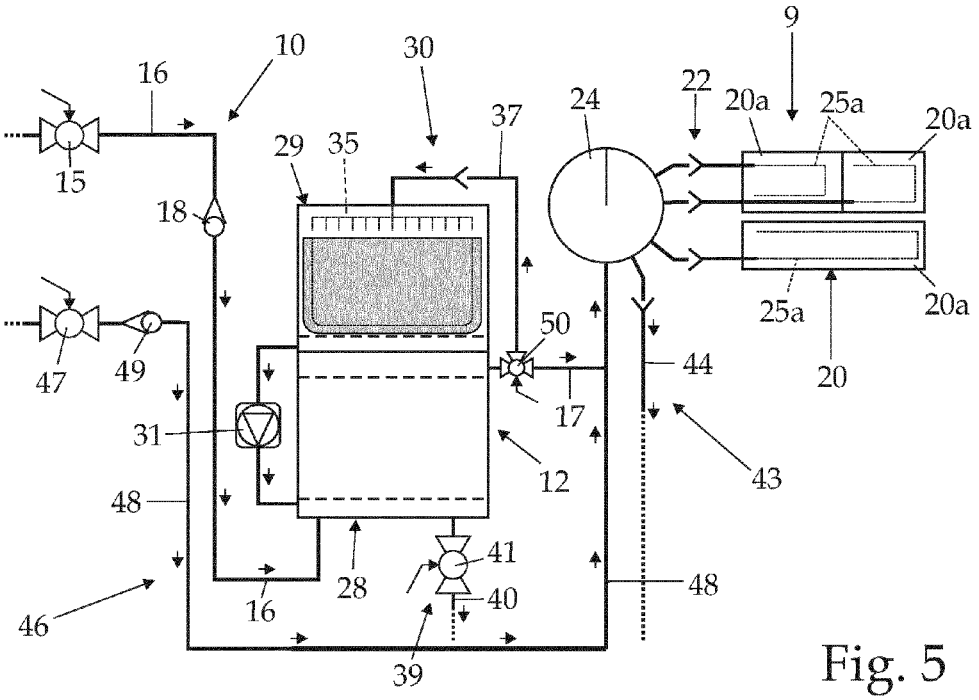
FIG. 5 is a schematic view of a first alternative embodiment of the internal water softening device of the FIG. 1 laundry washing machine.

With reference to FIG. 5, rather than being directly connected to the water mains, in an alternative embodiment of water softening device 12 the water supply circuit 30 preferably branches off from the fresh-water supply circuit 10 downstream of resin container 28, so as to selectively channel into the regeneration-agent reservoir 29 the water coming out of resin container 28.

In this embodiment, the water supply circuit 30 lacks the on-off valve 36 and instead comprises an electrically-controlled three-way valve 50 which is arranged along the fresh-water supply circuit 10, downstream of resin container 28, i.e. along the pipeline 17 connecting the outlet of resin container 28 to the inlet of the water supply circuit 22 of detergent dispensing assembly 9.

The pipeline 37 of water supply circuit 30 is now connected to the three-way valve 50, and the electrically-controlled three-way valve 50 is structured for selectively and alternatively channeling the water coming out of the resin container 28, to the sprinkler head 35 for producing the brine, or to the inlet of the water supply circuit 22 of detergent dispensing assembly 9 for performing the washing cycle.

In the FIG. 5 embodiment, at beginning of the regeneration process, the central control unit of laundry washing machine 1 sets the three-way valve 50 of water supply circuit 30 so as to put the outlet of resin container 28 in direct communication with the sprinkler head 35, and afterwards opens the on-off valve 15 of the fresh-water supply circuit 10 for enough time to channel into the regeneration-agent reservoir 29 the whole amount of fresh water necessary to form, either on the bottom of the basin-shaped container 33 or on the bottom portion of the drawer housing 14 of the drawer-like supporting structure 13, an amount of brine sufficient for the resin regeneration process to take place. This amount of fresh water obviously flows across the resin container 28 before reaching the regeneration-agent reservoir 29.

Then, after having closed again the on-off valve 15 of the fresh-water supply circuit 10, the central control unit of laundry washing machine 1 sets the three-way valve 50 so as to put again the outlet of resin container 28 in direct communication with the water drain line 43, i.e. with the detergent dispensing assembly 9, and afterwards activates the brine-circulating pump 31 to transfer/move the whole amount of brine at a time from the regeneration-agent reservoir 29, i.e. from the bottom of the basin-shaped container 33 or on the bottom portion of the drawer housing 14 of the drawer-like supporting structure 13, to the resin container 28.

When the water-softening agent container 28 is completely filled with a sufficient amount of brine, the central control unit of laundry washing machine 1 deactivates the brine-circulating pump 31 to watertight isolate the resin container 28 from the regeneration-agent reservoir 29.

Figure 6:
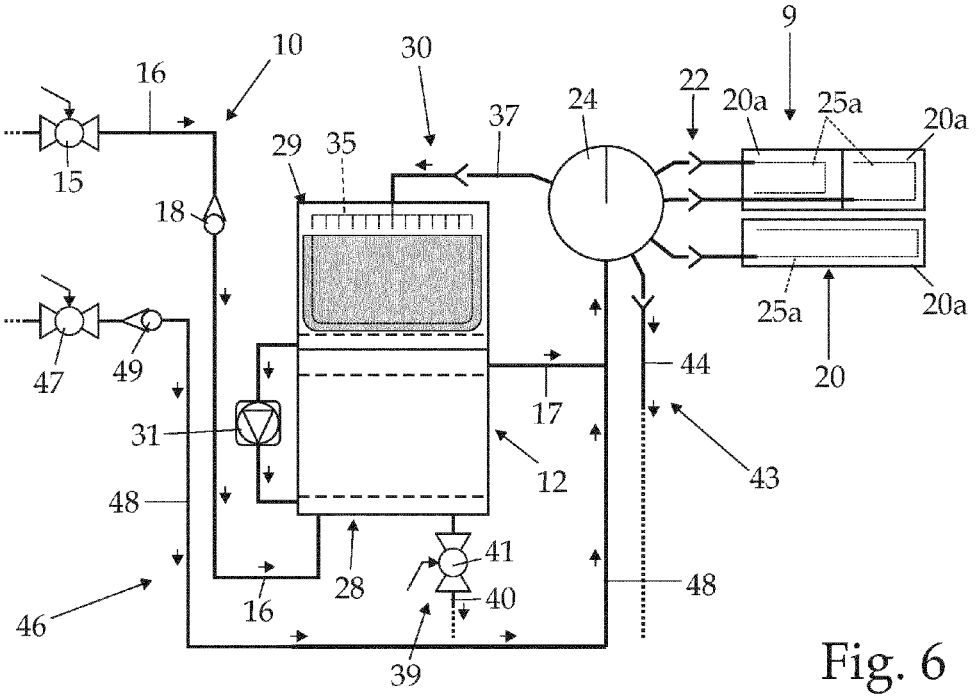
FIG. 6 is a schematic view of a second alternative embodiment of the internal water softening device of the FIG. 1 laundry washing machine.

With reference to FIG. 6, rather than branching off from the fresh-water supply circuit 10 upstream of the detergent dispensing assembly 9, in a second alternative embodiment of the water softening device 12 the water supply circuit 30 preferably branches off from the water supply circuit 22 of detergent dispensing assembly 9, so as to selectively channel into the regeneration-agent reservoir 29 the softened fresh water entering into the detergent dispensing assembly 9.

In other words, the water supply circuit 30 lacks the on-off valve 36 and the pipeline 37 of water supply circuit 30 is now connected to a specific additional water outlet of the electrically-controlled hydraulic distributor 24 of water supply circuit 22, and the electrically-controlled hydraulic distributor 24 is structured to selectively direct/channel into pipeline 37 the softened fresh water arriving from resin container 28 via pipeline 17.

In this embodiment, at beginning of the regeneration process, the central control unit of laundry washing machine 1 firstly arranges the hydraulic distributor 24 so as to channel towards the water supply circuit 30 the fresh water that arrives to the hydraulic distributor 24 from the resin container 28, and afterwards it opens the on-off valve 15 for enough time to channel into the regeneration-agent reservoir 29, the whole amount of fresh water necessary to form on the bottom of the basin-shaped container 33 or on the bottom portion of the drawer housing 14 of the drawer-like supporting structure 13, an amount of brine sufficient for the resin regeneration process to take place. This amount of fresh water obviously flows across the resin container 28 and the hydraulic distributor 24 of detergent dispensing assembly 9 before reaching the regeneration-agent reservoir 29.

Then, after having closed the on-off valve 15, the central control unit of laundry washing machine 1 sets/arranges the hydraulic distributor 24 of water supply circuit 22 so as to put the outlet of resin container 28 in communication with the second water drain line 43, and afterwards activates the brine-circulating pump 31 to transfer/move the whole amount of brine at a time from the regeneration-agent reservoir 29, i.e. from the bottom of the basin-shaped container 33 or on the bottom portion of the drawer housing 14 of the drawer-like supporting structure 13, to the resin container 28.

When the water-softening agent container 28 is completely filled with a sufficient amount of brine, the central control unit of laundry washing machine 1 deactivates the brine-circulating pump 31 to watertight isolate the resin container 28 from the regeneration-agent reservoir 29.

The advantages resulting from the arrangement of the regeneration-agent reservoir 29 of the water softening device 12 on the drawer-like supporting structure 13 of the appliance control panel 11 are remarkable. Firstly the arrangement of the regeneration-agent reservoir 29 at the upper left corner of front wall 2*a*, behind the appliance control panel 11, allows to significantly increase the capacity of the regeneration-agent reservoir 29. The space on the back of the appliance control panel 11, in fact, is generally empty, i.e. unused, even if relatively roomy.

As a result the user is requested to fill up the regeneration-agent reservoir 29 less frequently.

Furthermore the arrangement of the regeneration-agent reservoir 29 on the drawer-like supporting structure 13 so that the loading inlet or mouth of the same regeneration-agent reservoir 29 is freely accessible by the user when the drawer-like supporting structure 13 is arranged in the completely extracted position (see FIGS. 2 and 3), and is completely hidden and inaccessible by the user when the drawer-like supporting structure 13 is arranged in the retracted position (see FIG. 1), makes the refilling of the regeneration-agent reservoir 29 very user-friendly.

The second fresh-water supply circuit 46 bypassing the internal water softening device 12, instead, allows to improve the working flexibility of the laundry washing machine 1. During pre-wash or rinse phases of the washing cycle, when detergent agents are usually not required, the laundry washing machine 1 can use normal fresh water, thus lengthening the time between the regenerations of the ion-exchange resins.

In view of that, the appliance control panel 11 on front wall 2*a* may be structured so as to allow the user to manually select washing cycles that use softened fresh water, washing cycles that use normal, i.e. non-softened, fresh water, and finally washing cycles that use a mixture of softened and normal, i.e. non-softened, fresh water.

Clearly, changes may be made to the front-loading laundry washing machine 1 as described above without, however, departing from the scope of the present invention.

Figure 7:
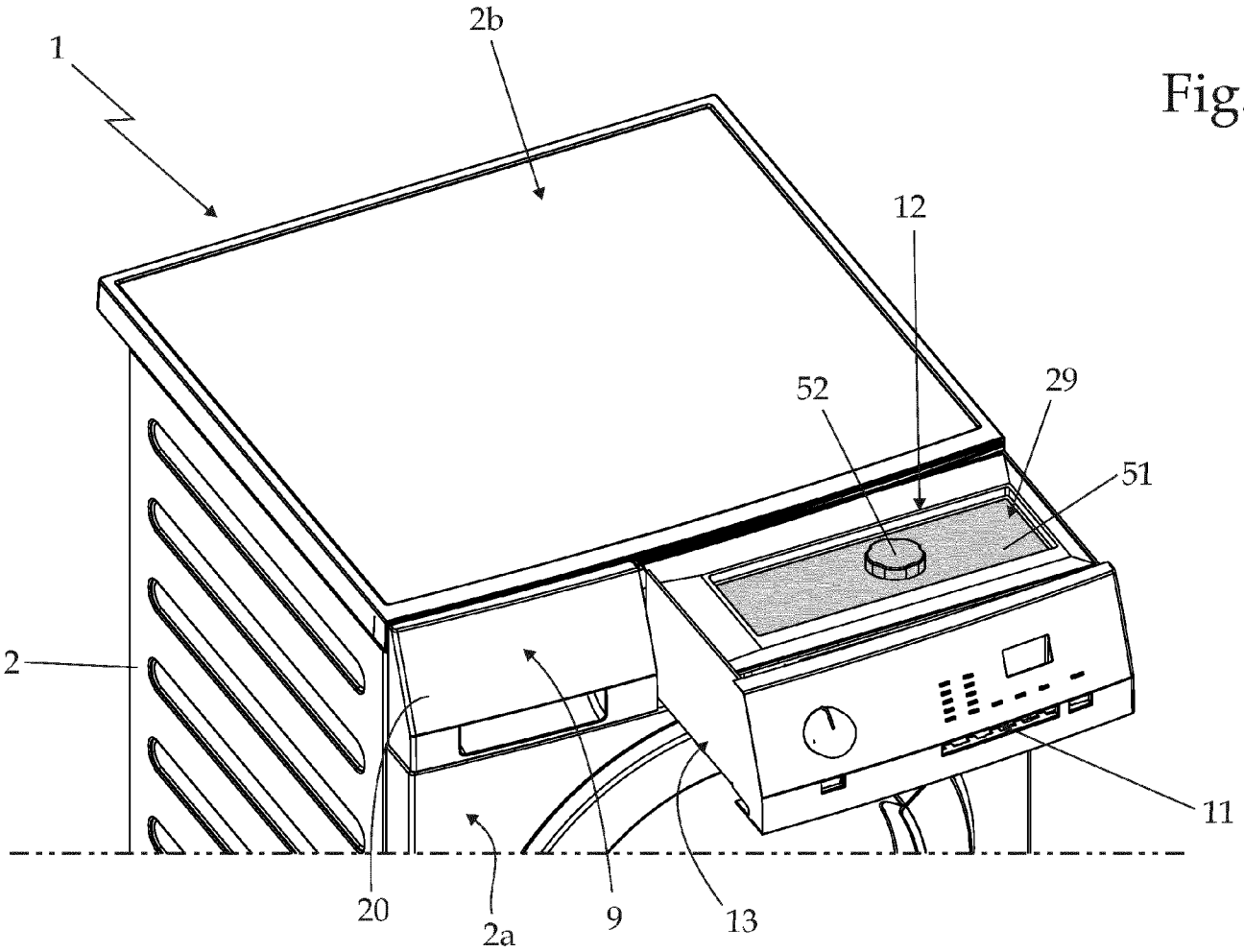
FIG. 7 is a perspective view of a second embodiment of the FIG. 1 laundry washing machine.
Figure 8:
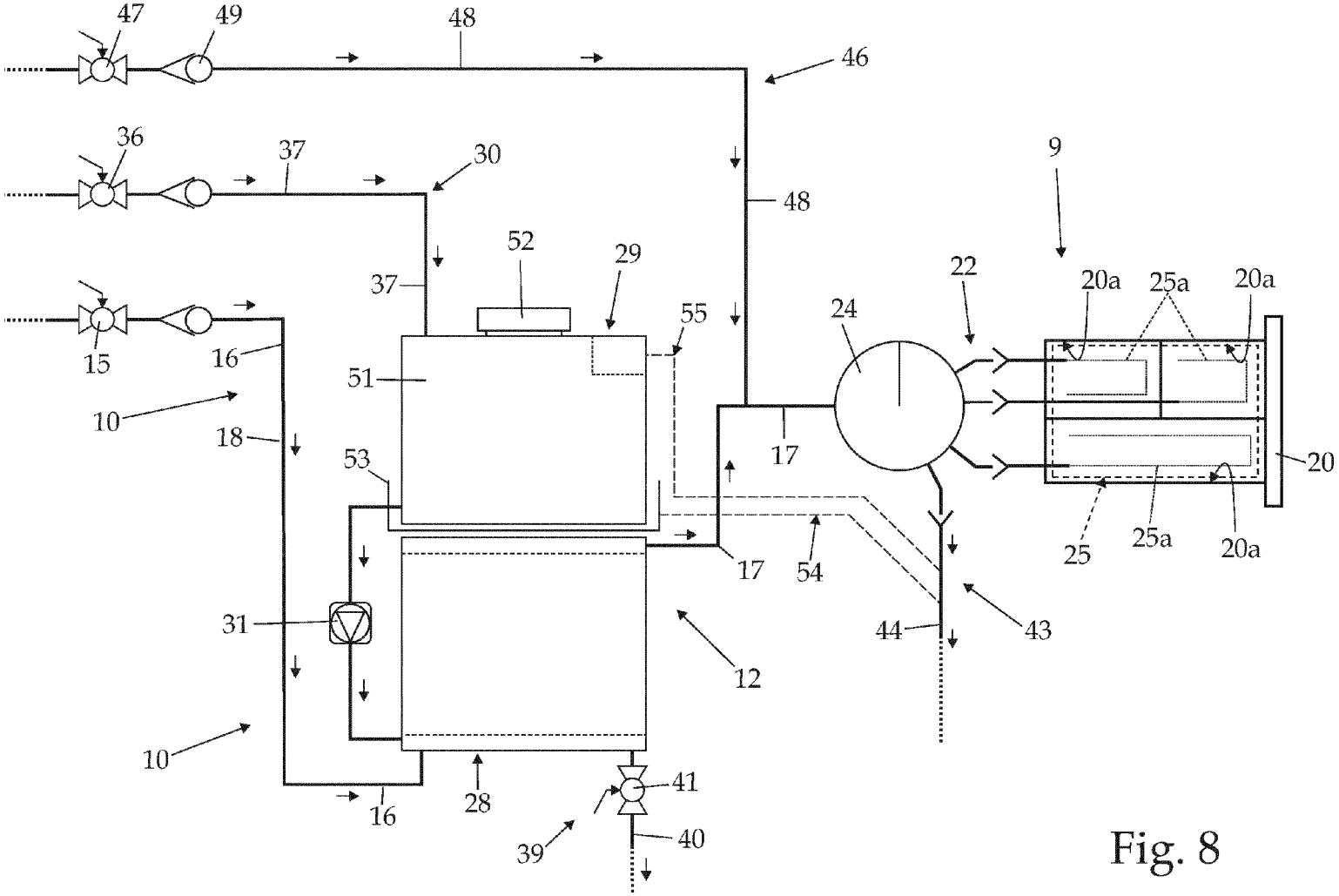
FIG. 8 is a schematic view of the internal water softening device of the FIG. 7 laundry washing machine, with parts removed for clarity.
Figure 9:
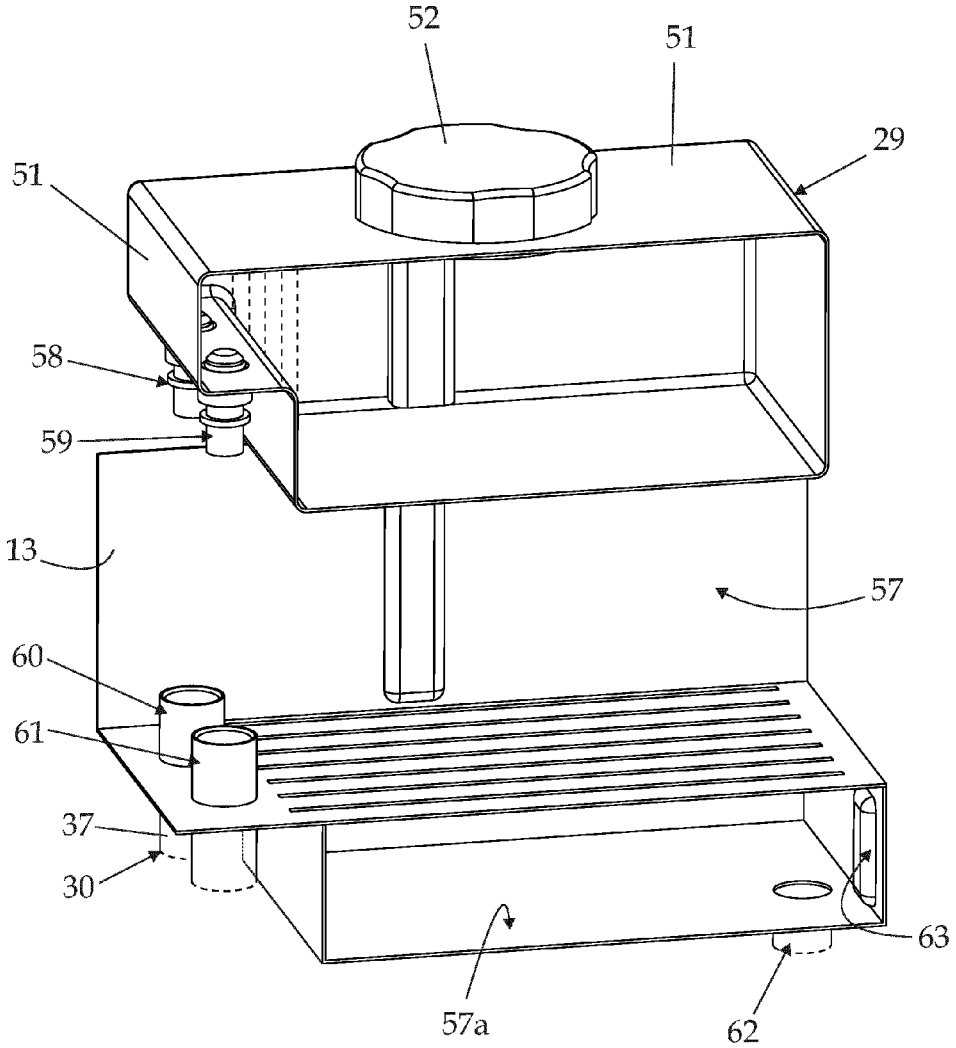

For example, with reference to FIGS. 7, 8 and 9, according to a more sophisticated embodiment of water softening device 12, differently from the FIG. 4, 5 or 6 embodiment the regeneration-agent reservoir 29 comprises: a preferably substantially parallelepiped-shaped, storage tank 51 which is structured for being manually fillable with a given quantity of consumable salt or other regeneration agent, and is housed into the drawer-like supporting structure 13 carrying the appliance control panel 11 so to be freely accessible by the user when the drawer-like supporting structure 13 is in the completely extracted position, and to be hidden and inaccessible by the user when the drawer-like supporting structure 13 is arranged in the retracted position; and a manually-removable cap 52 which is structured to close the storage tank 51, and is preferably located on top of storage tank 51 so as to be freely accessible by the user when the drawer-like supporting structure 13 is in the completely extracted position.

In the example shown, in particular, the storage tank 51 is preferably arranged/located on the drawer-like supporting structure 13 of the appliance control panel 11 so that at least the manually-removable cap 52 of storage tank 51 is freely accessible by the user when the drawer-like supporting structure 13 is arranged in the completely extracted position (see FIG. 7), and is completely hidden and inaccessible by the user when the drawer-like supporting structure 13 is arranged in the retracted position.

Being freely accessible by the user when the drawer-like supporting structure 13 is in the completely extracted position, the manually-removable cap 52 allows the user to load the consumable salt or other regeneration agent inside the regeneration-agent reservoir 29, and therefore forms the exposable loading inlet or mouth of the water softening device 12.

The water supply circuit 30 of water softening device 12, in turn, is preferably structured for channelling, on command, a given amount of fresh water from the water mains directly into the storage tank 51, so as to preferably completely dissolve at once the whole salt or other regeneration agents contained into storage tank 51 and form a great amount of brine (i.e. of salt water).

In this alternative embodiment, moreover, the water supply circuit 30 of water softening device 12 is preferably no more provided with the sprinkler head 35, and the pipeline 37 directly connects the electrically-controlled on-off valve 36 to storage tank 51.

Obviously, the water supply circuit 30 of water softening device 12 may also branch off from the fresh-water supply circuit 10 upstream of the detergent dispensing assembly 9 as disclosed in FIG. 5, or may branch off from the water supply circuit 22 of detergent dispensing assembly 9 as disclosed in FIG. 6, so as to selectively channel into the regeneration-agent reservoir 29 the softened fresh water entering into the detergent dispensing assembly 9.

The electrically-powered brine-circulating pump 31, in turn, is structured for selectively and alternatively sucking the brine (i.e. the salt water) from the storage tank 51 and delivery it to the water-softening agent container 28, or completely watertight sealing/isolating the storage tank 51 from the water-softening agent container 28, so as to prevent the brine (i.e. the salt water) contained into the storage tank 51 from flowing towards the water-softening agent container 28.

Again, the water softening device 12 preferably furthermore comprises a water-level sensor (not shown) which is structured for measuring the level of the fresh water and/or brine contained inside the storage tank 51, and/or a salinity-level sensor (not shown) which is structured for measuring the salinity degree of the brine contained inside the storage tank 51.

Preferably the storage tank 51 is moreover housed into the drawer-like supporting structure 13 either in unmovable or manually removable manner, and is furthermore dimensioned to contain an amount of brine sufficient for performing several resin regeneration processes.

More in particular, with reference to FIG. 8, the storage tank 51 of regeneration-agent reservoir 29 is preferably unmovably recessed/housed into the drawer-like supporting structure 13 of the appliance control panel 11, and the water softening device 12 is preferably provided with a preferably substantially basin-shaped, leakage collector 53 which is realized on the drawer-like supporting structure 13 of the appliance control panel 11 so as collect the brine or water accidentally coming out from the storage tank 51 during refilling of the consumable salt.

Preferably the water softening device 12 is furthermore provided with a third water drain line 54 which is structurally similar to the first water drain lines 39, but fluidically connects the leakage collector 53 of the drawer-like supporting structure 13 to the washing tub 3, and is structured to directly channel the water or brine accumulating into the leakage collector 53 towards the washing tub 3.

As an alternative, the water drain line 54 may be structured for channeling the brine or fresh water accumulating into the leakage collector 53 preferably into the drain sump (not shown) that extends downwards form the bottom of the washing tub 3, or into the water filtering assembly (not shown) that is interposed between the drain sump (not shown) of washing tub 3 and the suction of either the water circulating pump (not shown) or the water exhaust pump (not shown), or substantially directly into the water exhaust pump (not shown) which drains the waste water or washing liquor outside of the laundry washing machine 1, or in any case into the waste-water drain line that channels the waste water or washing liquor outside the laundry washing machine 1.

Preferably, though not necessarily, the regeneration-agent reservoir 29 furthermore comprises, in addition or alternatively to the drain line 54, an overflow drain line 55 which fluidically connects the storage tank 51 to the washing tub 3, and is structured for directly channelling the water or brine eventually exceeding the maximum capacity of the storage tank 51 towards the washing tub 3.

Obviously the overflow drain line 55 may alternatively be structured to channel the water or brine eventually exceeding the maximum capacity of the storage tank 51 towards the drain sump, or towards the water filtering assembly, or towards the water exhaust pump, or in any case towards the waste-water drain line that channels the waste water or washing liquor outside the laundry washing machine 1.

With reference to FIG. 9, according to an alternative embodiment the regeneration-agent reservoir 29 is housed into the drawer-like supporting structure 13 in manually removable manner.

In other words, the storage tank 51 is preferably recessed in manually extractable manner into a corresponding preferably substantially basin-shaped, complementary tank seat 57 realized on the drawer-like supporting structure 13 of the appliance control panel 11, and is preferably provided with two self-closing hydraulic connectors 58 and 59 which are structured to hydraulically connect in easily detachable manner the storage tank 51 to, respectively, the water supply circuit 30 and the suction of the brine-circulating pump 31, preferably during insertion of the storage tank 51 into the tank seat 57.

More in particular, each self-closing hydraulic connector 58, 59 of storage tank 51 is specifically structured to watertight couple in easily detachable manner with a corresponding complementary, preferably self-closing, hydraulic connector 60, 61 arranged on the drawer-like supporting structure 13.

The self-closing hydraulic connector 60 directly communicates with the water supply circuit 30 of water softening device 12 and, when suitably coupled to the self-closing hydraulic connector 58, allows the fresh water arriving from water supply circuit 30 to freely flow into storage tank 51.

The self-closing hydraulic connector 61, in turn, directly communicates with the suction of the brine-circulating pump 31, and allows, when suitably coupled to the self-closing hydraulic connector 59, the brine stored into the storage tank 51 to freely flow out of the storage tank 51 towards the brine-circulating pump 31.

Each self-closing hydraulic connector 58, 59 of storage tank 51 is furthermore structured so as to remain closed in watertight manner when uncoupled from the corresponding complementary self-closing hydraulic connector 60, 61 of the drawer-like supporting structure 13. Similarly each self-closing hydraulic connector 60, 61 of drawer-like supporting structure 13 is preferably structured so as to remain closed in watertight manner when uncoupled from the corresponding complementary self-closing hydraulic connector 58, 59 of storage tank 51.

With reference to FIG. 9, in the example shown, in particular, the storage tank 51 of the regeneration-agent reservoir 29 is preferably structured so as to be vertically insertable into the tank seat 57 on the drawer-like supporting structure 13 when the latter is arranged in the completely extracted position (see FIG. 7). The self-closing hydraulic connectors 60 and 61, in turn, are preferably arranged inside the tank seat 57, preferably on the bottom of the same tank seat 57.

Furthermore the bottom 57*a* of tank seat 57 is preferably, though not necessarily, shaped/structured so as to form a catchment basin or kind leakage collector wherein the fresh water or brine leaking out of the storage tank 51 may accumulate. This catchment basin, in turn, is preferably connected to the bottom of washing tub 3 via a corresponding water drain line 62 which is structurally similar to water drain lines 39 and 43.

As an alternative, the water drain line 62 may be structured for channelling the brine or fresh water accumulating on the bottom 57*a* of tank seat 57 preferably into the drain sump (not shown) that extends downwards form the bottom of washing tub 3, or into the water filtering assembly (not shown) that is interposed between the drain sump (not shown) of washing tub 3 and the suction of the water circulating pump (not shown) and/or of the water exhaust pump (not shown) of the laundry washing machine 1, or in any case into the waste-water drain line that channels the waste water or washing liquor outside the laundry washing machine 1.

With reference to FIG. 9, the regeneration-agent reservoir 29 is preferably also provided with a second water-level sensor 63 which is located on the bottom of tank seat 57 and is structured is able to measure the level of the fresh water and/or brine accumulated on the catchment basin formed on the bottom of tank seat 57, and the electronic central control unit (not shown) of the laundry washing machine 1 activates the water drain line 62 when the level of brine and/or fresh water on the bottom of tank seat 57 exceeds a given threshold value.

Operation of the FIG. 8 water softening device 12 is slightly different from that of FIG. 4, 5 or 6. In this embodiment, in fact, the central control unit of laundry washing machine 1 is preferably no more requested to channel the requested amount of fresh water into the regeneration-agent reservoir 29 at beginning of each regeneration process.

In the FIG. 8 embodiment, in fact, the central control unit of laundry washing machine 1 can open the on-off valve 36 of water supply circuit 30 for a predetermined time interval at any time before the beginning of the regeneration process, so as to completely fill up the storage tank 51 with fresh water.

Since the electrically-powered brine-circulating pump 31 is still configured so as to completely watertight seal/isolate the storage tank 51 from the water-softening agent container 28, the entry of fresh water into the storage tank 51 may naturally stop before the subsequent closing of the on-off valve 36, when the storage tank 51 is completely full of water.

The fresh water channelled into storage tank 51 obviously dissolves the whole salt contained into the storage tank 51 and forms a great amount of brine (i.e. of salt water) sufficient for performing several resin regeneration processes. This great amount of brine remains inside the storage tank 51 until a resin regeneration process is requested to take place.

Thus, assuming that the storage tank 51 already contains a given amount of brine sufficient for performing one or more resin regeneration processes and that the on-off valve 36 is closed, at beginning of the regeneration process the central control unit of laundry washing machine 1 closes the on-off valve 15 of the fresh-water supply circuit 10 to stop the flow of fresh water across the resin container 18, and preferably arranges the hydraulic distributor 24 of detergent dispensing assembly 9 so as to channel the fresh water arriving from the resin container 28 directly into the second water drain line 43.

Afterwards, the central control unit of laundry washing machine 1 activates the brine-circulating pump 31 to move/pump the requested amount of brine from the storage tank 51 of the regeneration-agent reservoir 29 to the resin container 28.

If, at any time during pumping of the brine, the central control unit of laundry washing machine 1 determines that the level of the brine inside the storage tank 51 is too low, it may temporarily open again the on-off valve 36 to channel some more fresh water into the storage tank 51 via the water supply circuit 30.

When the resin container 28 is completely filled with a sufficient amount of brine, the central control unit of laundry washing machine 1 switches off the electrically-powered brine-circulating pump 31 to stop the movement of the brine from the storage tank 51 to the resin container 28, so as to watertight isolate the resin container 28 from the regeneration-agent reservoir 29.

The central control unit of laundry washing machine 1 then keeps the resin container 28 completely full of brine for a predetermined time interval generally sufficient to allow the brine contained into the resin container 28 to remove from the ion-exchange resins the calcium and magnesium ions previously combined/fixed to said resins.

When the regeneration process of the ion-exchange resins is completed, the central control unit of laundry washing machine 1 opens again the on-off valve 15 of fresh-water supply circuit 10, so that the pressurized fresh water of the water mains can push the brine out of the resin container 28.

Operation of the FIGS. 7, 8 and 9 embodiment of laundry washing machine 1 then continues as disclosed with reference to FIG. 4, 5 or 6 according to the layout of the water supply circuit 30, with the difference that some brine remains stored inside the storage tank 51, ready for being used in the next resin regeneration process.

Figure 10:
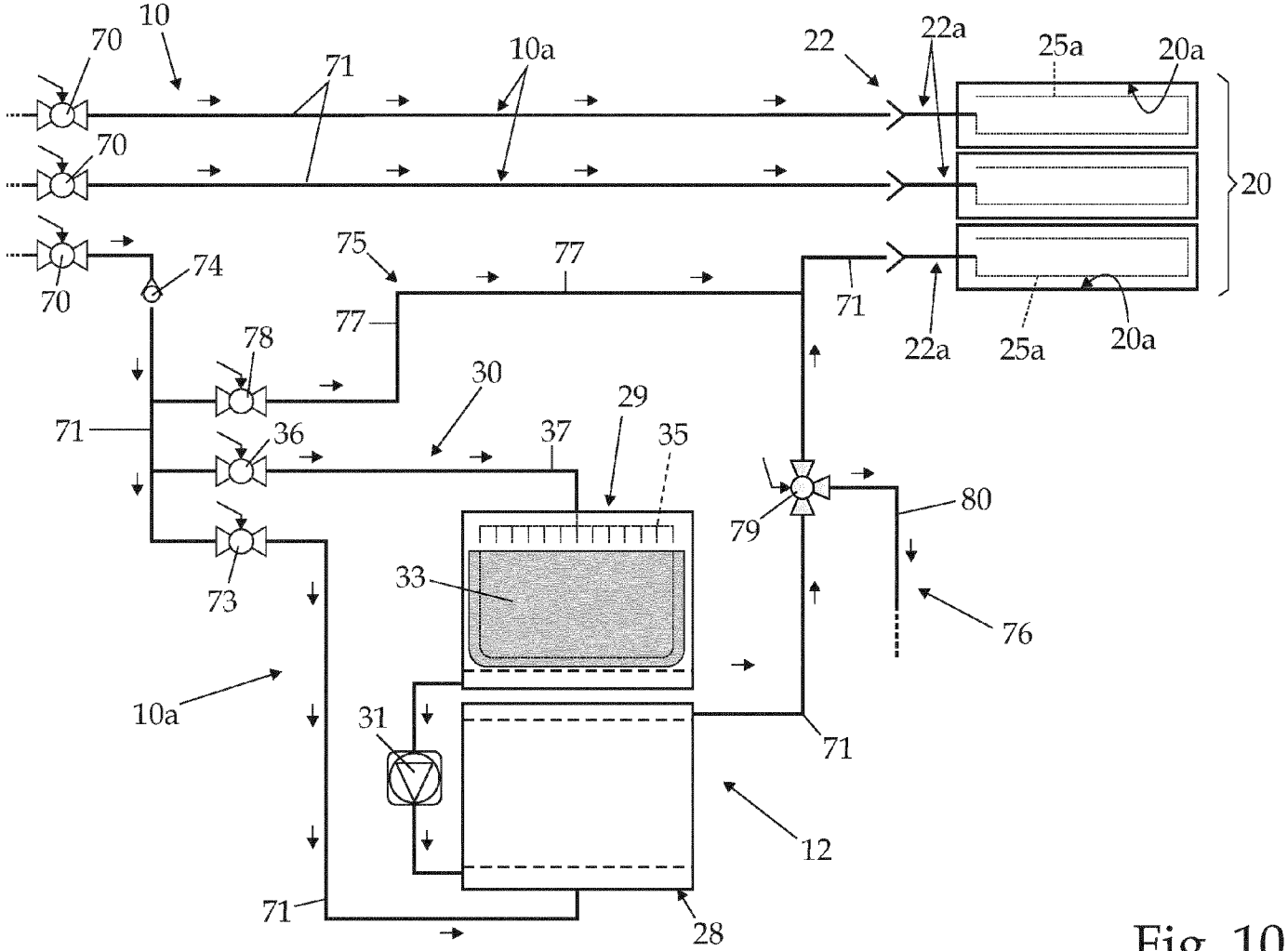
FIG. 10 is a schematic view of an alternative embodiment of the internal water softening device of the FIG. 7 laundry washing machine.

With reference to FIG. 10, in a second cost-saving alternative embodiment of the laundry washing machine 1, the fresh-water supply circuit 10 preferably comprises a plurality of independent fresh-water supply lines 10*a*, each of which is independently connected to the water mains and is structured for selectively channelling the fresh water from the water mains directly to a corresponding detergent compartment 20*a* of the detergent drawer 20; and the water softening device 12 is located along the fresh-water supply line 10*a* that channels the fresh water of the water mains towards the detergent compartment 20*a* structured for containing the amount of detergent or other washing agent to be used in the main-wash phase of the washing cycle.

The water supply circuit 22 of the detergent dispensing assembly 9, in turn, is divided into a plurality of independent water supply lines 22*a*, each of which is directly connected to a corresponding fresh-water supply line 10*a* of the fresh-water supply circuit 10, and is structured for channelling the fresh water arriving from the corresponding fresh-water supply line 10*a* exclusively to a corresponding detergent compartment 20*a* of the detergent drawer 20.

In the example shown, in particular, the detergent drawer 20 is preferably provided with three detergent compartments 20*a* which are structured for respectively containing the amount of detergent or other washing agent to be used in the main-wash phase of the washing cycle, the amount of detergent or other washing agent to be used in the pre-wash phase of the washing cycle, and finally the amount of softener, stain-remover or other washing agent to be used in the final-wash phase of the washing cycle; whereas the fresh-water supply circuit 10 is preferably provided with three independent fresh-water supply lines 10*a*, each of which is independently connected to the water mains and is structured for selectively channelling the fresh water towards a corresponding detergent compartment 20*a* of the detergent drawer 20.

More specifically, each independent water supply line 22*a* of the water supply circuit 22 is preferably structured so as to directly connect a corresponding fresh-water supply line 10*a* of the fresh-water supply circuit 10 to a corresponding shower-making portion/section 25*a* of sprinkler head 25 located above a corresponding detergent compartment 20*a* of detergent drawer 20.

With reference to FIG. 10, in the example shown, in particular, each fresh-water supply line 10*a* of the fresh-water supply circuit 10 preferably comprises an electrically-controlled on-off valve 70 which is interposed between the water mains and the corresponding water supply line 22*a* of the water supply circuit 22, and is able to control/regulate the flow of fresh water from the water mains towards said water supply line 22*a*; and a pipeline 71 directly connecting said on-off valve 70 to the corresponding water supply line 22*a* of water supply circuit 22 of detergent dispensing assembly 9.

Similarly to the previous embodiments, the water softening device 12 is still provided with the water-softening agent container 28 and with the regeneration-agent reservoir 29, both housed inside the casing 2. In this case, however, the water-softening agent container 28 is located along the fresh-water supply line 10*a* that channels the fresh water of the water mains towards the detergent compartment 20*a* structured for containing the amount of detergent or other washing agent to be used in the main-wash phase of the washing cycle.

More in particular, in the example shown the water-softening agent container 28 is preferably arranged along the pipeline 71 of the fresh-water supply line 10*a* that channels the fresh water of the water mains towards the water supply line 22*a* of detergent dispensing assembly 9 that ends in the shower-making portion/section 25*a* of sprinkler head 25 located immediately above the detergent compartment 20*a* structured for containing the amount of detergent or other washing agent to be used in the main-wash phase of the washing cycle.

Similarly to FIGS. 1 to 6 embodiment, the regeneration-agent reservoir 29 is still at least partly located into the drawer-like supporting structure 13 carrying the appliance control panel 11, and again preferably comprises a substantially basin-shaped, regeneration-agent container 33 which is manually fillable with a given quantity of consumable salt or other regeneration agent, and is located/incorporated into the drawer-like supporting structure 13 of the appliance control panel 11, so that the upper mouth 33*a* of the basin-shaped container 33 is freely accessible by the user when the drawer-like supporting structure 13 is arranged in the completely extracted position (see FIGS. 2 and 3), and is completely hidden and inaccessible by the user when the drawer-like supporting structure 13 is arranged in the retracted position (see FIG. 1).

Obviously, alternatively the regeneration-agent reservoir 29 may comprise: a storage tank 51 which is structured for being manually fillable with a given quantity of consumable salt or other regeneration agent, and is housed into the drawer-like supporting structure 13 carrying the appliance control panel 11 either in unmovable or manually removable manner; and the manually-removable cap 52 which is structured to closed the storage tank 51.

With reference to FIG. 10, in this embodiment the internal water softening device 12 furthermore comprises an auxiliary electrically-controlled on-off valve 73 which is located along the fresh-water supply line 10*a* that channels the fresh water of the water mains towards the detergent compartment 20*a* structured for containing the amount of detergent or other washing agent to be used in the main-wash phase of the washing cycle, immediately upstream of the water-softening agent container 28, so as to be able to selectively and alternatively allow or prevent the flow of fresh water from the water mains towards the water-softening agent container 28; and the water supply circuit 30 branches off from the fresh-water supply line 10*a* immediately upstream of the auxiliary on-off valve 73, so as to selectively channel into the storage tank 51 the fresh water that flows along the fresh-water supply line 10*a*.

In the example shown, in particular, the pipeline 37 of water supply circuit 30 preferably branches off from pipeline 71 of fresh-water supply line 10*a* downstream of the on-off valve 70 and upstream of the auxiliary on-off valve 73, and ends into the sprinkler head 35 associated to the drawer housing 14 (or directly into the storage tank 51 if a storage tank 51 is used); and the on-off valve 36 of water supply circuit 30 is preferably located/arranged along pipeline 37, so as to control/regulate the flow of fresh water that flows from the pipeline 71 of fresh-water supply line 10*a* to the regeneration-agent reservoir 29.

Preferably, the internal water softening device 12 furthermore comprises a one-way valve 74 which is located immediately downstream of the on-off valve 70 of the fresh-water supply line 10*a*, i.e. between the on-off valve 70 and the on-off valve 73, and is arranged so to allow the fresh water to only flow along the pipeline 71, from the water mains to the water softening device 12 and not vice versa; and the water supply circuit 30 branches off from the fresh-water supply line 10*a* downstream of the one-way valve 74.

With reference to FIG. 10, the internal water softening device 12 preferably finally comprises a water by-pass circuit 75 and optionally also an auxiliary water drain line 76.

The water by-pass circuit 75 preferably branches off from the fresh-water supply line 10*a* upstream of the auxiliary on-off valve 73 and downstream of the on-off valve 70, or the one-way valve 74 if present, and is structured to selectively redirect/channel the fresh water that flows along the fresh-water supply line 10*a* towards the water-softening agent container 28, directly towards the water supply line 22*a* of detergent dispensing assembly 9 that channels the fresh water to the detergent compartment 20*a* structured for containing the amount of detergent or other washing agent to be used in the main-wash phase of the washing cycle, thus bypassing at once the whole water-softening agent container 28.

The water by-pass circuit 75, therefore, allows to selectively channel non-softened fresh water to the detergent compartment 20*a* structured for containing the amount of detergent or other washing agent to be used in the main-wash phase of the washing cycle.

In the example shown, in particular, the water by-pass circuit 75 preferably comprises a connecting pipeline 77 that branches off from pipeline 71 of fresh-water supply line 10*a* upstream of on-off valve 73, and connects again to pipeline 71, or directly to the inlet of the corresponding water supply line 22*a* of detergent dispensing assembly 9, downstream of the water-softening agent container 28; and an electrically-controlled on-off valve 78 which is located along the connecting pipeline 77 so as to be able to selectively and alternatively allow or prevent the flow of fresh water along connecting pipeline 77, directly towards the corresponding water supply line 22*a* of detergent dispensing assembly 9 while bypassing at once the whole water-softening agent container 28.

The auxiliary water drain line 76, in turn, is structured for selectively rerouting directly into the washing tub 3 the brine or fresh water that comes out from the resin container 28 and flows along the fresh-water supply line 10*a* directed towards the detergent dispensing assembly 9, so as to bypass the detergent comportment 20*a* of detergent drawer 20 which is structured for containing the amount of detergent or other washing agent to be used in the main-wash phase of the washing cycle.

Alike the water drain line 43, the auxiliary water drain line 76 may also be structured for directly channelling the brine or fresh water coming out from the resin container 28 directed towards the detergent dispensing assembly 9, preferably into the drain sump (not shown) that extends downwards form the bottom of washing tub 3, or into the water filtering assembly (not shown) that is interposed between the drain sump (not shown) of washing tub 3 and the suction of the water circulating pump (not shown) and/or of the water exhaust pump (not shown) of the laundry washing machine 1, or in any case into the waste-water drain line that channels the waste water or washing liquor outside the laundry washing machine 1.

In the example shown, in particular, the auxiliary water drain line 76 is structured to selectively reroute the brine or fresh water that flows out of the resin container 28 along the final section of pipeline 71, and preferably comprises, immediately upstream of the detergent dispensing assembly 9, an electrically-controlled three-way valve 79 which has a first outlet connected to the inlet of the appropriate water supply line 22*a* of water supply circuit 22, and a second outlet connected to a pipeline 80 that ends directly into the washing tub 3, or into the drain sump, or into the water filtering assembly, or into the water exhaust pump.

The electrically-controlled three-way valve 79 is structured for selectively and alternatively channelling the brine or softened fresh water coming out of the resin container 28 either to pipeline 80 or to the inlet of the water supply line 22*a* of water supply circuit 22.

Finally, according to a non-shown and less-sophisticated embodiment the brine-circulating pump or pump assembly 31 may be replaced by an electrically-controlled on-off valve which is structured to selectively and alternatively put the regeneration-agent reservoir 29 in direct communication with the water-softening agent container 28 for allowing the brine to flow by gravity from the regeneration-agent reservoir 29 to the water-softening agent container 28, or to completely watertight seal/isolate the regeneration-agent reservoir 29 from the water-softening agent container 28.

The invention claimed is:

1. A laundry washing machine comprising an outer casing and, inside said outer casing, a washing tub, a rotatable drum housed in axially rotatable manner inside the washing tub and structured for housing the laundry to be washed, a detergent dispensing assembly which is structured for supplying detergent into the washing tub, a fresh-water supply circuit which is structured for selectively channeling a flow of fresh water from the water mains towards the detergent dispensing assembly and/or the washing tub, and a water softening device which is arranged/located along the fresh-water supply circuit and is structured for reducing the hardness degree of the fresh water channeled to the detergent dispensing assembly and/or the washing tub;

the water softening device comprising a water-softening agent container which is arranged/located along the fresh-water supply circuit and is filled with a water softening agent able to reduce the hardness degree of the fresh water flowing through the same water-softening agent container, and a regeneration-agent reservoir which is fluidly connected to the water-softening agent container and is structured to receive a consumable regeneration agent for performing a regeneration of the water softening function of the water softening agent stored into the water-softening agent container;

the laundry washing machine further comprising an appliance control panel which is structured for allowing the user to manually select the desired washing-cycle and is located on a front wall of the casing, and wherein said appliance control panel is located/arranged at a front side of a drawer-like supporting structure which is fitted/inserted in extractable manner into the front wall of the casing, so as to be movable between a retracted position in which the drawer-like supporting structure is recessed into the front wall of the casing, and an extracted position in which the drawer-like supporting structure partly juts out from front wall of the casing and the appliance control panel is forward spaced apart from front wall of the casing; and wherein the water softening device is provided with an exposable loading inlet or mouth structured for allowing the user to load the regeneration agent inside the regeneration-agent reservoir, and is moreover at least partly arranged/located on the drawer-like supporting structure so that said loading inlet or mouth is freely accessible by the user when the drawer-like supporting structure is arranged in the extracted position;

the detergent dispensing assembly arranged inside the casing and provided with a corresponding exposable loading inlet or mouth located on the front wall of the casing, beside the drawer-like supporting structure carrying the appliance control panel, and structured for allowing the user to load the detergent or other washing agent inside the detergent dispensing assembly.

2. The laundry washing machine according to claim 1, wherein the washing tub comprises an opening or mouth directly facing a laundry loading/unloading opening realized in the front wall of the casing, and in that the drawer-like supporting structure is fitted/inserted in extractable manner into the front wall of the casing above said laundry loading/unloading opening.

3. The laundry washing machine according to claim 1, wherein the detergent dispensing assembly comprises a detergent container which is fillable with a given quantity of detergent, softener and/or other washing agent, and which is housed inside the casing into a corresponding container housing; the front wall of the casing being provided with a corresponding pass-through opening through which the detergent container is accessible by the user.

4. The laundry washing machine according to claim 3, wherein the detergent dispensing assembly comprises a detergent drawer which is manually fillable with a given quantity of detergent, softener and/or other washing agent, and is fitted/inserted in manually extractable manner into a recessed drawer housing which extends inside the casing while remaining above the washing tub, and communicates with the outside of the casing via a front entrance or opening provided at the front wall of the casing above the laundry loading/unloading opening and beside the drawer-like supporting structure.

5. The laundry washing machine according to claim 1, wherein the water softening device further comprises a water supply circuit which is structured for channelling a given amount of fresh water into the regeneration-agent reservoir so to at least partly dissolve the regeneration agents stored therein to form some brine.

6. The laundry washing machine according to claim 1, wherein the water softening device further comprises a pump assembly or valve assembly which is interposed between the water-softening agent container and the regeneration-agent reservoir, and is structured for regulating/controlling the outflow of the brine from the regeneration-agent reservoir to the water-softening agent container.

7. The laundry washing machine according to claim 1, wherein the regeneration-agent reservoir is at least partly located/incorporated into the drawer-like supporting structure.

8. The laundry washing machine according to claim 7, wherein the regeneration-agent reservoir is housed into the drawer-like supporting structure in a manually removable manner.

9. The laundry washing machine according to claim 7, wherein the regeneration-agent reservoir comprises a substantially basin-shaped, regeneration-agent container which is manually fillable with a given quantity of consumable regeneration agent, and is located/incorporated into the drawer-like supporting structure so that the mouth of the basin-shaped container is freely accessible by the user when the drawer-like supporting structure is arranged in the extracted position, and is hidden and inaccessible by the user when the drawer-like supporting structure is arranged in the retracted position.

10. The laundry washing machine according to claim 9, wherein a water supply circuit of the water softening device is structured for spilling/pouring a shower of the water droplets by gravity into the substantially basin-shaped container of the regeneration-agent reservoir when the drawer-like supporting structure is arranged in the retracted position.

11. The laundry washing machine according to claim 1, wherein the regeneration-agent reservoir comprises: a storage tank which is structured for being manually fillable with a given quantity of consumable regeneration agent, and is housed into the drawer-like supporting structure so to be freely accessible by the user when the drawer-like supporting structure is in the extracted position, and to be hidden and inaccessible by the user when the drawer-like supporting structure is arranged in the retracted position; and a manually-removable cap which is structured to closed the storage tank.

12. The laundry washing machine according to claim 11, wherein a water supply circuit of the water softening device is structured for channelling the fresh water directly into the storage tank, so as to substantially dissolve the regeneration agents contained into the storage tank and form brine.

13. The laundry washing machine according to claim 11, wherein the storage tank is housed into the drawer-like supporting structure in a manually removable manner.

14. The laundry washing machine according to claim 13, wherein the storage tank of the regeneration-agent reservoir is recessed in manually extractable manner into a corresponding tank seat realized on the drawer-like supporting structure, and is provided with at least two self-closing hydraulic connectors which are structured to substantially watertight couple in easily detachable manner with corresponding complementary self-closing hydraulic connectors arranged on the drawer-like supporting structure; a first self-closing complementary hydraulic connector being in direct communication with a water supply circuit of the internal water softening device; a second self-closing complementary hydraulic connector being in direct communication with the water-softening agent container.

15. The laundry washing machine according to claim 1, further comprising a second fresh-water supply circuit which is connected to the water mains independently from the main fresh-water supply circuit, and is structured for selectively channelling the fresh water from the water mains to the detergent dispensing assembly and/or to the washing tub, while bypassing the water softening device.

16. The laundry washing machine according to claim 1, wherein said appliance control panel is structured so as to allow the user to manually select the desired washing cycle between washing cycles that use softened fresh water, washing cycles that use non-softened fresh water, and washing cycles that use a mixture of softened and non-softened fresh water.

* * * * *